US011168891B2

(12) United States Patent
Le Blanc

(10) Patent No.: US 11,168,891 B2
(45) Date of Patent: Nov. 9, 2021

(54) CHILDPROOF SAFETY GRATE AND SAFETY COOKWARE SYSTEM

(71) Applicant: Eric Le Blanc, Murrieta, CA (US)

(72) Inventor: Eric Le Blanc, Murrieta, CA (US)

( * ) Notice: Subject to any disclaimer, the term of this patent is extended or adjusted under 35 U.S.C. 154(b) by 0 days.

(21) Appl. No.: 16/872,011

(22) Filed: May 11, 2020

(65) Prior Publication Data

US 2021/0317995 A1 Oct. 14, 2021

Related U.S. Application Data

(63) Continuation-in-part of application No. 16/847,366, filed on Apr. 13, 2020.

(51) Int. Cl.
*F24C 15/10* (2006.01)

(52) U.S. Cl.
CPC ..... *F24C 15/107* (2013.01)

(58) Field of Classification Search
CPC ..... A47J 36/34; A47G 23/0683; F24C 15/107
USPC ..... 248/176.2; 220/630
See application file for complete search history.

(56) References Cited

U.S. PATENT DOCUMENTS 1,781,056 A * 11/1930 Elder ..... A47J 36/34 211/41.2
3,198,189 A * 8/1965 Oatley ..... F24C 15/36 126/24
3,313,919 A * 4/1967 Richardson ..... H05B 3/68 219/433
3,372,688 A * 3/1968 Moore ..... F24C 15/107 126/24
5,474,206 A * 12/1995 Herring, Sr. ..... A47J 43/0727 220/630
5,743,045 A * 4/1998 Hicks ..... A01G 9/04 47/71
8,297,272 B2 * 10/2012 Williams ..... F24C 15/36 126/42
8,561,957 B2 * 10/2013 Levine ..... A47J 36/34 248/346.03
2018/0303267 A1 * 10/2018 Le Blanc ..... A47J 36/34

* cited by examiner

*Primary Examiner* — Muhammad Ijaz

(57) ABSTRACT

Embodiments of the invention relate to a safety grate and safety cookware system. More particularly, the present invention relates to a safety cookware device having a heated cookware appliance and a keyed safety locking member, and a keyed safety burner grate having an outer frame, raised metal fingers, a grate locking component connected to the first rail member and the second rail member, the grate locking component may include a keyed slot for receiving the keyed block member when inserted into the keyed slot.

20 Claims, 33 Drawing Sheets

CHILDPROOF SAFETY GRATE AND SAFETY COOKWARE SYSTEM

RELATED APPLICATIONS

This application claims the benefit of priority of U.S. application Ser. No. 16/847,366, filed Apr. 13, 2020, which is herein incorporated by reference to the present application.

FIELD OF THE INVENTION

The present invention relates to a childproof safety grate and safety cookware system. More particularly, the present invention pertains to cooking vessels, such as pots and pans, having a safety feature which is configured to lock to the burner grate of a stovetop, preventing these types of cookware vessels from accidentally tipping or being pulled off from the stovetop by a child. Further, the present invention provides a burner grate having a channel insert member and keyed insert slot disposed near a top portion of the burner grate which guides and receives a keyed safety locking member of a safety cookware device.

BACKGROUND

Burn injuries to children in the United States which require medical attention are in the hundreds of thousands each year based on some recent burn statistics of children between 1-17 years old. A substantial number of these injuries are frequently related to scalds from spilled food such as, for example, when a child pulls a pot off of a stovetop.

To prevent such injuries, some stovetop safety devices are available which are designed to retain, cover, or prevent access to the cooking vessels on the stovetop. One example of a stovetop safety device includes a stove pot retainer having a retaining member contacting the sides of a cooking vessel to support the vessel in unstable conditions. In another example, the stovetop safety device may include lateral securing elements which are fixed onto the stove by means of suction cups, the lateral securing elements holding the pot or pan in place, making accidents less likely. In yet another example, the stovetop safety device may include a burner grate flame deflector having a plate-like member and a downwardly extending protective skirt for preventing flames or heat from heating a pot handle.

These stovetop safety devices may provide some protection for adult users but may generally lack the necessary failsafe mechanisms that specifically protect children from stovetop related burn injuries. Therefore, there is a need for a stovetop safety device that is specifically configured to prevent tipping or pulling a cookware vessel off of the stovetop, thereby decreasing the risk of burn injuries or death to small children.

SUMMARY

One object of this invention is to provide a safety grate and safety cookware system including a safety cookware device and keyed safety burner grate. The safety cookware device may include a heated cookware appliance and a keyed safety locking member. The keyed safety locking member may be coupled to a bottom portion of the heated cookware appliance. The keyed safety locking member may include a keyed block member and a stem for coupling the keyed block member to the heated cookware appliance. The keyed safety burner grate may have an outer frame, a plurality of raised metal fingers coupled to an inner portion of the outer frame, a first rail member and a second rail member, separated by a fixed distance. The first rail member and the second rail member may be coupled to the inner portion of the outer frame. A grate locking component may be coupled to the first rail member and the second rail member, and the grate locking component may include a keyed slot for receiving the keyed block member when inserted into the keyed slot. The safety cookware device may be configured to freely rotate around the grate locking component about the stem of the safety cookware device when inserted, and the safety cookware device may be unlocked and removable from the keyed safety burner grate at an unlocked position when the keyed block member is first inserted into the keyed slot. The safety cookware device may be locked and secured to the keyed safety burner grate at a locked position when the keyed block member is inserted into the keyed slot of the keyed safety burner grate and then rotated 45 degrees or more in a clockwise or counterclockwise direction.

Another object of this invention is to provide a safety grate and safety cookware system including a safety cookware device and a keyed safety burner grate. The safety cookware device may have a heated cookware appliance and a keyed safety locking member. The keyed safety locking member may be coupled to a bottom portion of the heated cookware appliance. The keyed safety locking member may include a keyed block member and a stem for coupling the keyed block member to the heated cookware appliance. The keyed safety burner grate may have an outer frame, a plurality of raised metal fingers coupled to an inner portion of the outer frame, a channel insert slot formed by two insert guide rail members coupled to a first end of the outer frame, two stem guide rail members coupled to a second end of the outer frame, and a grate locking component having a channel stop coupling the two insert guide rail members with the two stem guide rail members. The two insert guide rail members may be separated by a first fixed distance at a first end of the outer frame, and the two stem guide rail members may be separated by a second fixed distance at a second end of the outer frame. The first fixed distance may be greater than the second fixed distance. The stem and the keyed block member of the safety cookware device may be inserted into the channel insert slot prior to locking the keyed block member to the grate locking component, and the stem and the keyed block member may be inserted and then locked into the grate locking component, stopping at the channel stop.

These and other objects, features and advantages of the present invention will become more apparent in light of the following detailed description of preferred embodiments thereof, as illustrated in the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION

The present invention provides a system of multiple heating cookware components to benefit small children by providing a safety mechanism which 1) positions the cooking vessel so that the handle of the cookware vessel does not extend beyond the front of the stovetop and 2) locks a cooking vessel to the burner grate of a stovetop, thereby preventing the handle of the cooking vessel from being out of reach or accidentally pulled off the stovetop by a child.

Figure 1:
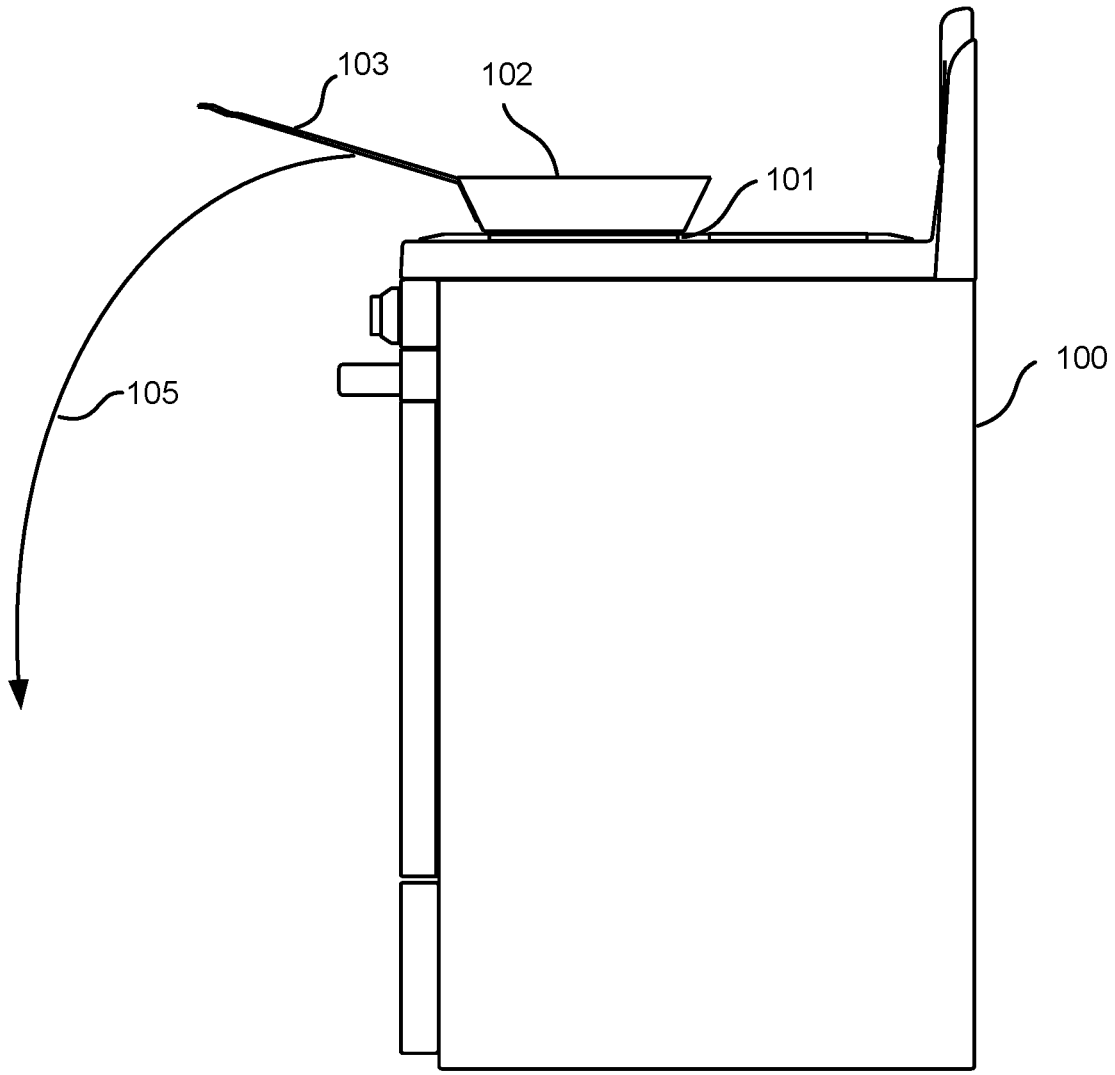
FIG. 1 illustrates a side view of a stovetop oven with a frying pan situated on the top of a burner grate of the stovetop.
Figure 2:
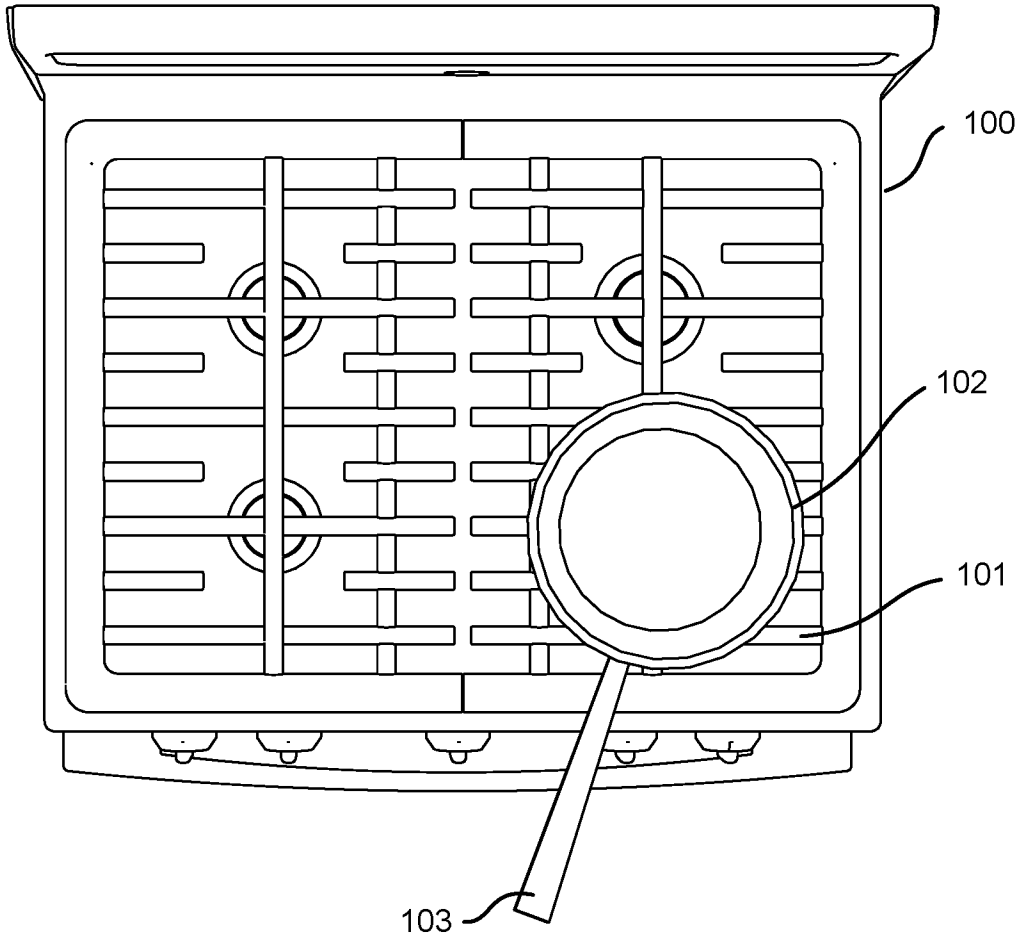
FIG. 2 illustrates a top view of the same stovetop oven with the pan situated on the top of the burner grate of the stovetop.
Figure 3B:
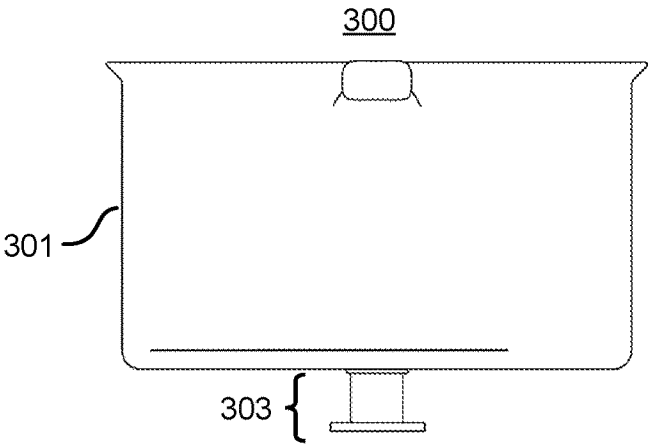
FIG. 3A-FIG. 3D illustrate a bottom, a front side, a left side, and a bottom perspective view, respectively, of a safety cookware device having a cookware coupled to a keyed safety locking member, according to an embodiment.
Figure 3D:
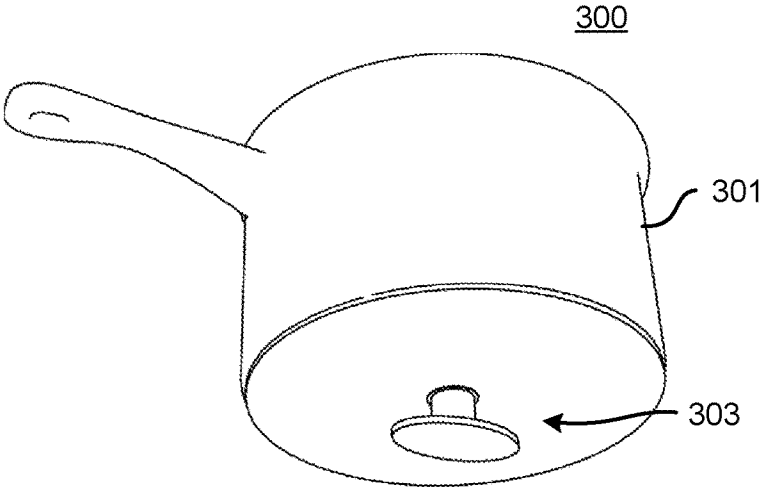
Figure 3A:
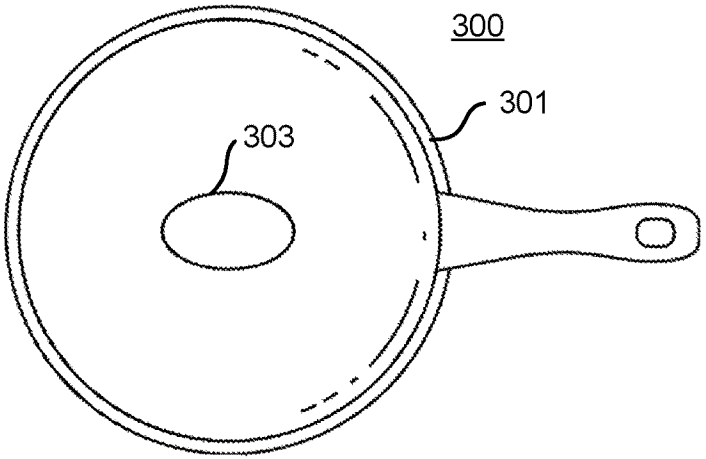
Figure 3C:
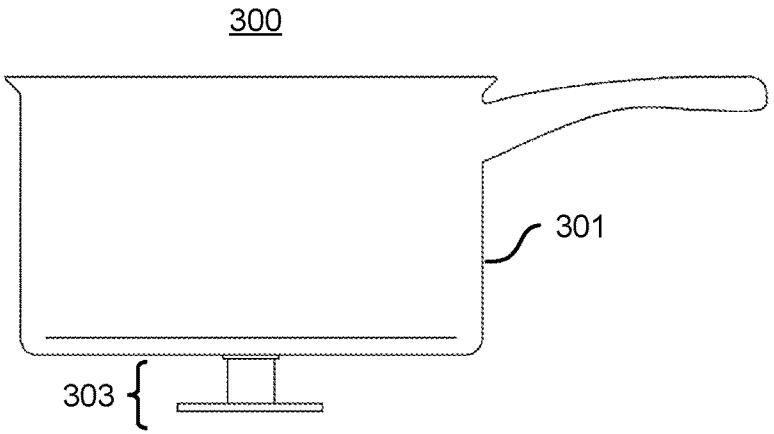
Figure 4A:
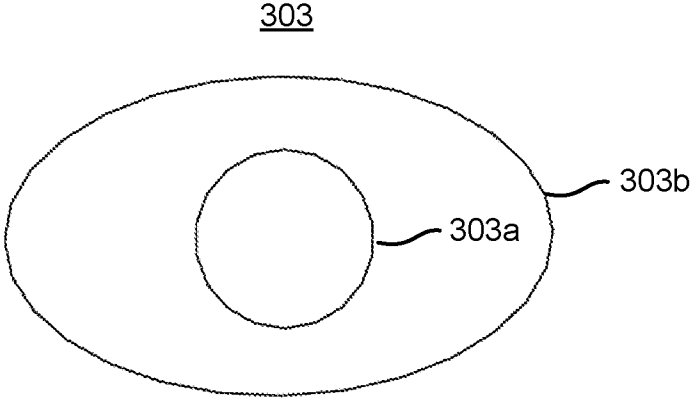
FIG. 4A-FIG. 4D illustrate a top, a front side, a left side, and a top perspective view, respectively, of the keyed safety locking member isolated from the safety cookware device, according to an embodiment.
Figure 4B:
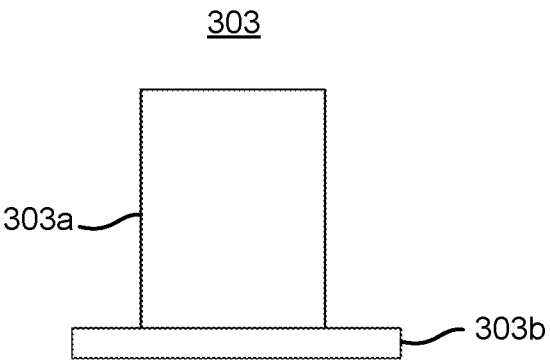
Figure 4C:
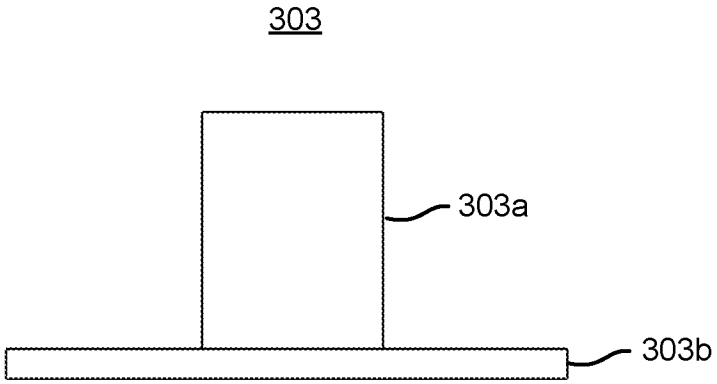
Figure 4D:
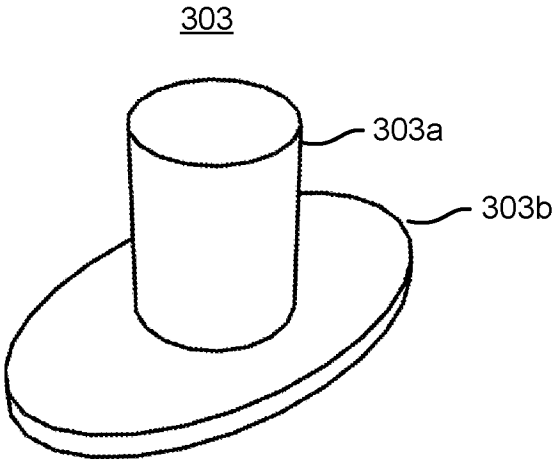

FIG. 1 illustrates a side view of a stovetop oven 100 with a frying pan 102 situated on the top of a burner grate 101 of the stovetop 100. In a typical cooking scenario, the pan 102 may include a handle 103 that is placed on the stovetop 100 so that the handle 103 extends beyond the front side of the stovetop 100, creating an unsafe condition for small children. For example, because the handle 103 is situated to the front of the stovetop 100, the handle 103 may be within reach for the child to pull and tip the pan 102 in a downward direction 105, potentially causing serious burn injuries to the child. FIG. 2 illustrates a top view of the same stovetop oven 100 with the pan 102 situated on the top of the burner grate 101 of the stovetop 100.

FIG. 3A-FIG. 3D illustrate a bottom, a front side, a left side, and a bottom perspective view, respectively, of a safety cookware device 300 having a heated cookware appliance 301, such as a pot or pan, coupled to a keyed safety locking member 303 that is centrally positioned and disposed on a bottom portion of the cookware 301, according to an embodiment. The keyed safety locking member 303 may be configured to be of the same material as the heated cookware appliance 301 such as metal, glass, ceramics, or composite materials or other materials that are capable of withstanding high temperatures and suitable for cooking. In addition, the keyed safety member 303 and the heated cookware appliance 301 may be molded or fabricated as a single unitary piece or made to include additional interlocking components which allow the keyed safety member 303 to be easily removed or attached to the cookware 301.

FIG. 4A-FIG. 4D illustrate a top, a front side, a left side, and a top perspective view, respectively, of the keyed safety locking member 303 isolated from the safety cookware device 300, according to an embodiment. In this implementation, the safety locking member 303 may include a stem 303*a* or shaft member coupled to a keyed block member 303*b*. The stem 303*a* having one end portion connected to the safety cookware device 300 and another end portion connected to the keyed block member 303*b*. In this implementation, the keyed block member 303*b* is a thin oval-shaped plate, while the stem 303*a* is cylindrical in shape. In other implementations, the keyed block member 303*b* may include any other types of shapes (e.g., round, rectangular, star-like, triangular, disc-shaped, other symmetrically or asymmetrically shaped objects. Similarly, the stem 303*a* may include other types shaft members including rods, plates, bars, and tubes. Moreover, the stem 303*a* may also include multiple shaft members that, as a whole, form the stem 303*a*.

Figure 5A:
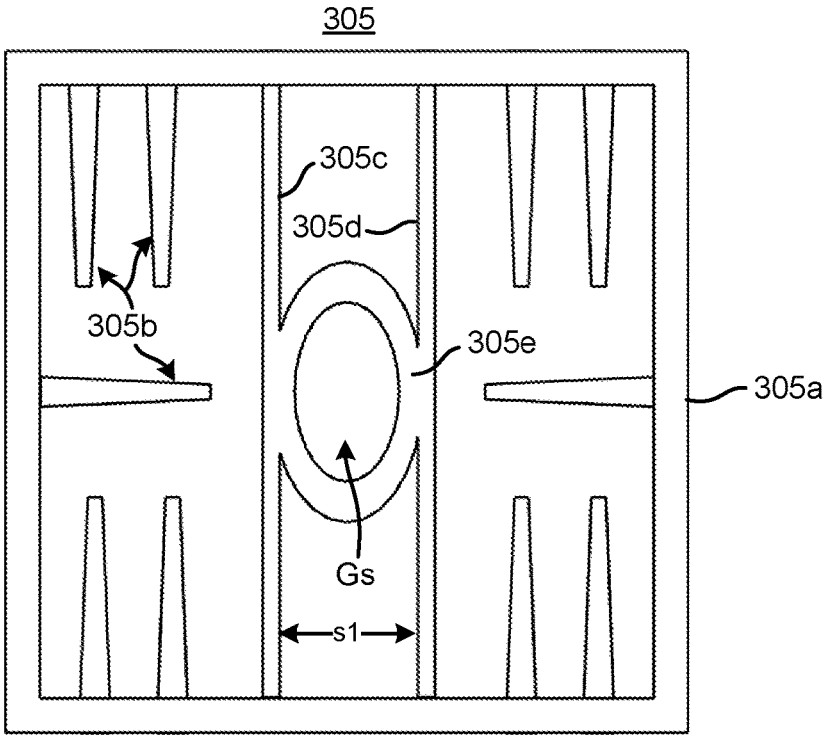
FIG. 5A-FIG. 5C illustrate a top, a front side, and a top perspective view, respectively, of a keyed safety burner grate, according to an embodiment.
Figure 5B:
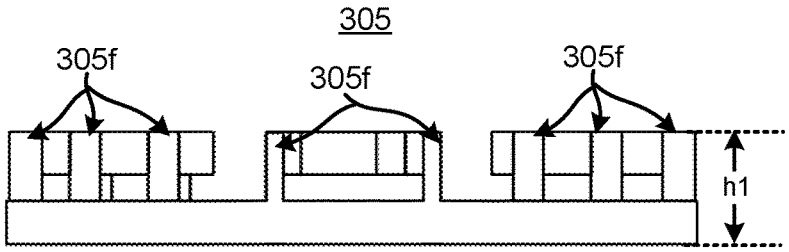
Figure 5C:
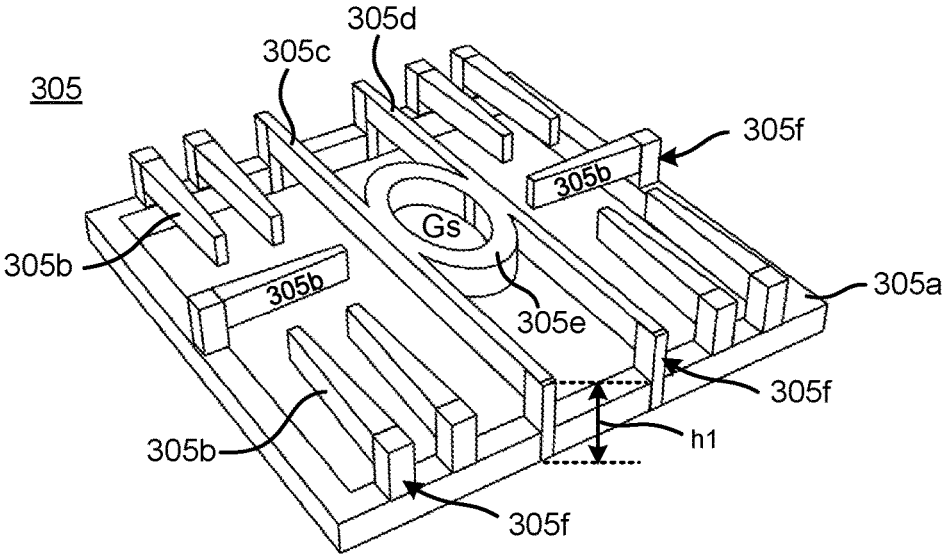

FIG. 5A-FIG. 5C illustrate a top, a front side, and a top perspective view, respectively, of a keyed safety burner grate 305, according to an embodiment. The keyed safety burner grate 305 may include an outer frame 305*a* and a plurality of raised metal fingers 303*b* attached to an inner portion of the outer frame 305*a* via posts 305*f*. The keyed safety burner grate 305 may also include a first rail member 305*c* and a second rail member 305*d*, separated by distance s1, where each end of each rail member (305*c*, 305*d*) is attached to the inner portion of the outer frame 305*a* via posts 305*f* and raised at a same height h1 as the metal fingers 303*b*. The keyed safety burner grate 305 may also include a grate locking component 305*e* coupling the first rail member 305*c* to the second rail member 305*d*. In this implementation, the grate locking component 305*e* includes curvilinear metal members forming an oval slot Gs having an inner portion with the same shape, size and pattern of the keyed block member 303*b*.

Figure 6B:
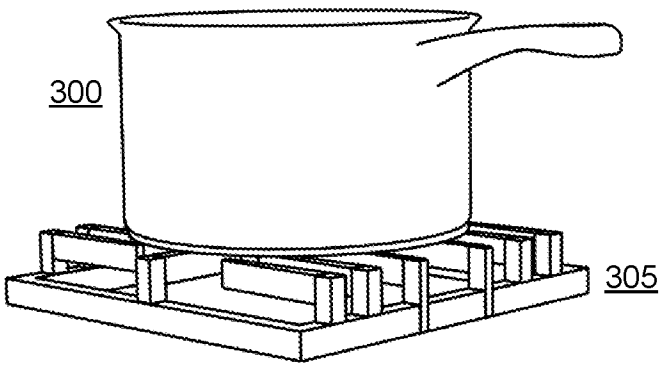
FIG. 6A-FIG. 6D illustrate a method of inserting the safety cookware device into the keyed safety burner grate, according to an embodiment.
Figure 6D:
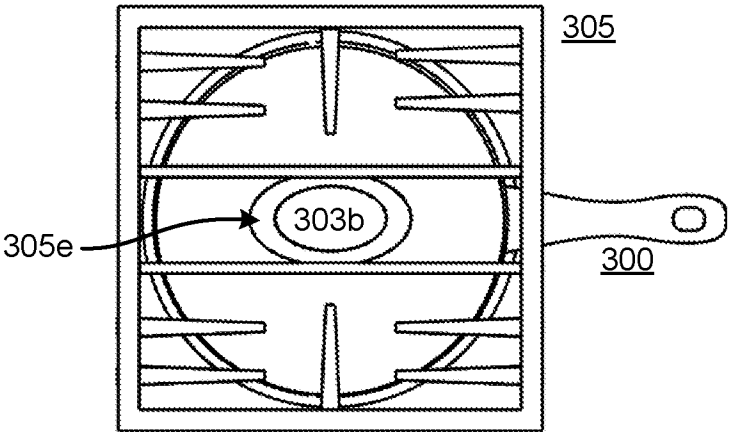
Figure 6A:
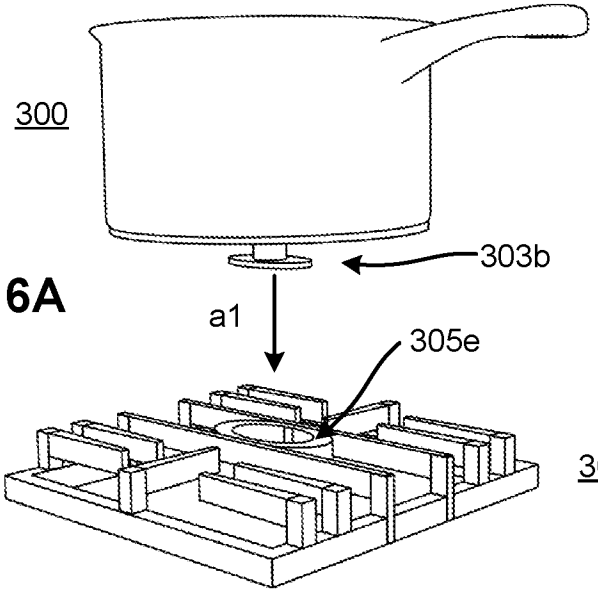
Figure 6C:
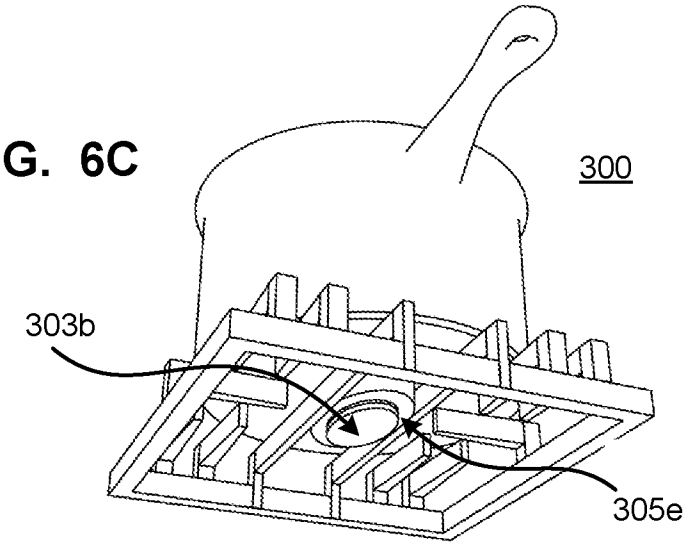

FIG. 6A-FIG. 6D illustrate a method of inserting the safety cookware device 300 into the keyed safety burner grate 305, according to an embodiment. FIG. 6A depicts a front perspective view of the safety cookware device 300 positioned above and approximately centered to the keyed safety burner grate 305, where the thin oval-shaped plate of keyed block member 303*b* is in alignment with the oval slot Gs of the grate locking component 305*e*. Once aligned, the safety cookware device 300 may be lowered (a1) so that the thin oval-shaped plate of keyed block member 303*b* is mated and inserted into the oval slot Gs, allowing the safety cookware device 300 to securely rest on the surface of the keyed safety burner grate 305, as shown in FIG. 6B and FIG. 6C. Once inserted, the thin oval-shaped plate of keyed block member 303*b* is disposed slightly below the grate locking component 305*e*, allowing the safety cookware device 300 to rotate around the grate locking component 305*e* along the stem 303*a* of the safety cookware device 300. FIG. 6D illustrates a bottom view of the safety cookware device 300 inserted to the keyed safety burner grate 305.

Figure 7C:
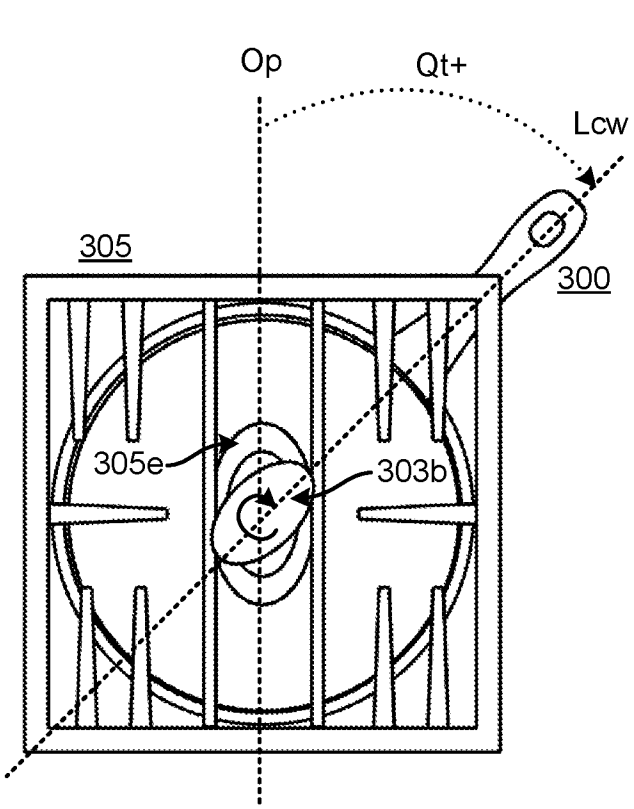
FIG. 7A-FIG. 7C illustrate an example of locking the safety cookware device to the keyed safety burner grate after insertion, according to an embodiments.
Figure 7B:
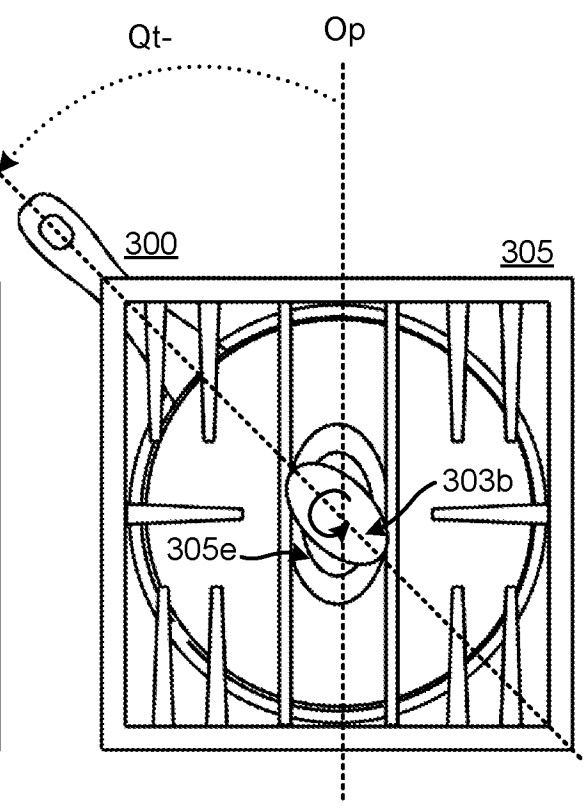
Figure 7A:
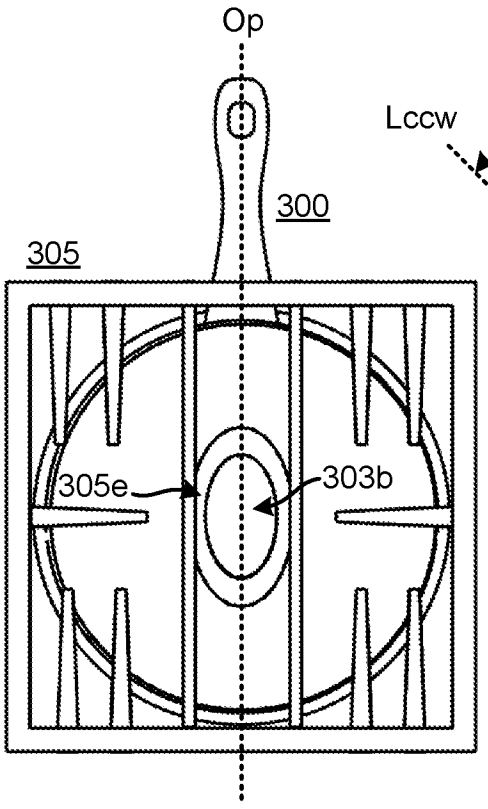

FIG. 7A-FIG. 7C illustrate an example of locking the safety cookware device 300 to the keyed safety burner grate 305 after insertion, according to an embodiments. FIG. 7A illustrates a bottom view of the safety cookware device 300 in an unlocked position Op with respect to the grate locking component 305*e* of the keyed safety burner grate 305. In the unlocked position Op, the shape and pattern of the thin oval-shaped plate of keyed block member 303*b* of the safety cookware device 300 is in alignment with the shape and pattern of the grate locking component 305*e* of the keyed safety burner grate 305, allowing the user to freely insert and remove the safety cookware device 300 from the keyed safety burner grate 305. FIG. 7B illustrates a bottom view of the safety cookware device 300 in a first locking position Lccw with respect to the grate locking component 305*e* of the keyed safety burner grate 305. In the first locking position Lccw, the safety cookware device 300 is rotated −45 degrees or more (Qt−) in a counterclockwise (CCW) direction from its original position Op to the first locking position Lccw, causing a portion of the thin oval-shaped plate of keyed block member 303*b* to catch and rest against the grate locking component 305*e*, locking it into place, and preventing the safety cookware device 300 from being removed from the keyed safety burner grate 305. FIG. 7C illustrates a bottom view of the safety cookware device 300 in a second locking position Lcw with respect to the grate locking component 305*e* of the keyed safety burner grate 305. In the second locking position Lcw, the safety cookware device 300 is rotated +45 degrees or more (Qt+) in a counterclockwise (CCW) direction from its original position Op to the second locking position Lccw, causing the portion of the thin oval-shaped plate of keyed block member 303*b* to catch and rest against the grate locking component 305*e*, locking it into place, and preventing the safety cookware device 300 from being removed from the keyed safety burner grate 305.

Figure 8A:
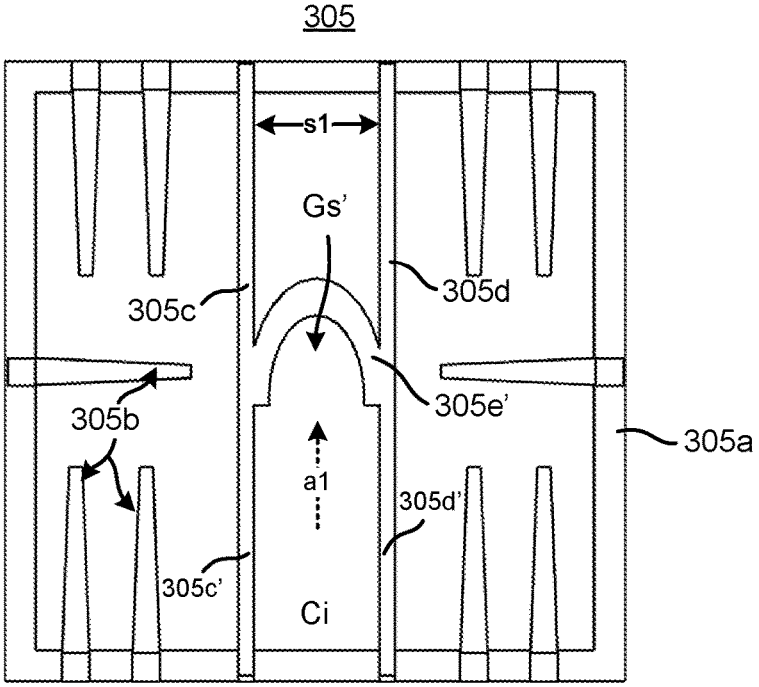
FIG. 8A-FIG. 8C illustrate a top, a front side, and a top perspective view, respectively, of the keyed safety burner grate having a channel insert slot, according to an embodiment.
Figure 8B:
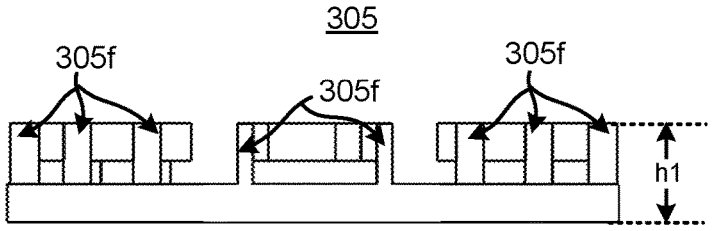
Figure 8C:
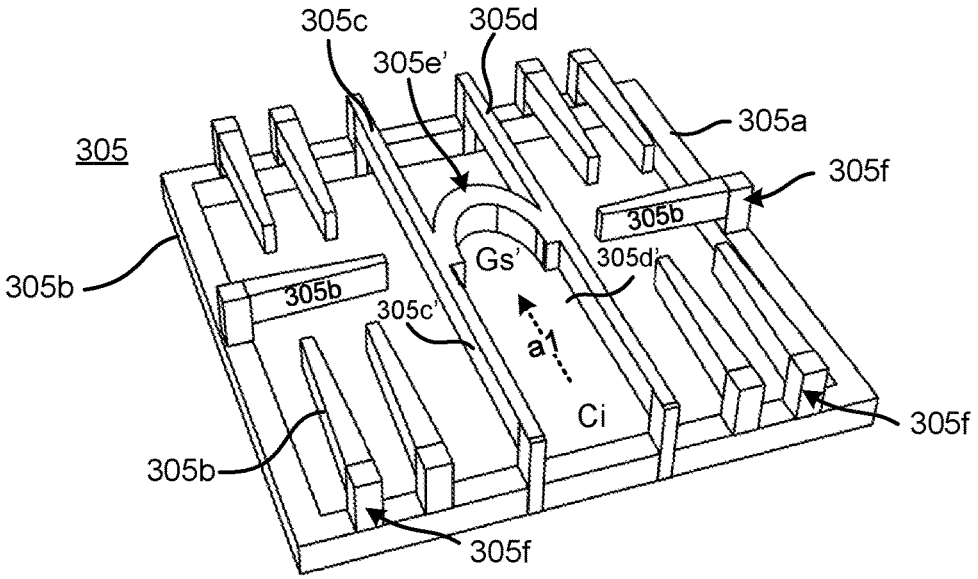

FIG. 8A-FIG. 8C illustrate a top, a front side, and a top perspective view, respectively, of the keyed safety burner grate 305 having a channel insert slot Ci, according to an embodiment. In the previous embodiment, the grate locking component 305*e* includes the oval slot Gs which is closed at both ends of the first rail member 305*c* and the second rail member 305*d*. In the current embodiment, a half grate locking component 305*e*' includes a curvilinear bar (or channel stop) defining a half oval slot Gs'. Portions of the half grate locking component 305*e*' (or channel stop), the first open-ended rail member 305*c*', and the second open-ended rail member 305*d*' define the channel insert slot Ci as shown in FIG. 8A and FIG. 8C. In practice, the safety locking member 303 of the safety cookware device 300 may be directly inserted into the channel insert slot Ci, sliding the safety locking member 303 in a forward direction a1 towards the half grate locking component 305*e*', and stopping at the channel stop to engage with the half grate locking component 305*e*'.

Figure 9B:
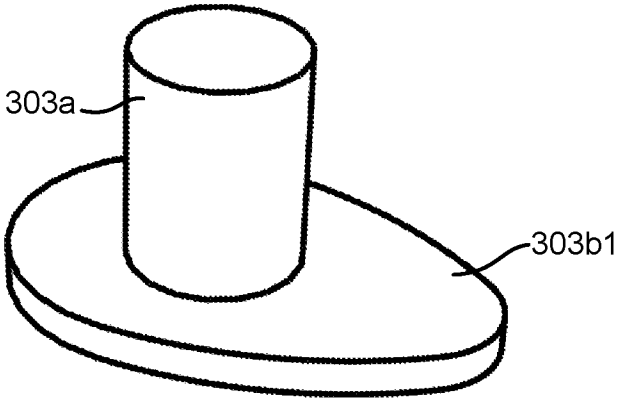
FIG. 9A-FIG. 9B illustrate a top and a top perspective view, respectively, of the keyed safety locking member having an egg-shaped keyed block member, according to another embodiment.
Figure 9A:
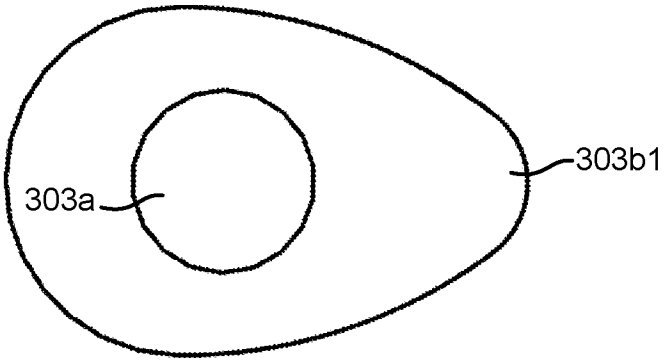

FIG. 9A-FIG. 9B illustrate a top and a top perspective view, respectively, of the keyed safety locking member 303 having an egg-shaped keyed block member 303*b*1, according to another embodiment. In this implementation, the safety locking member 303 may include the stem 303*a* coupled to the egg-shaped keyed block member 303*b*1. The stem 303*a* having one end portion connected to the safety cookware device 300 and another end portion connected to the egg-shaped keyed block member 303*b*1.

Figure 10A:
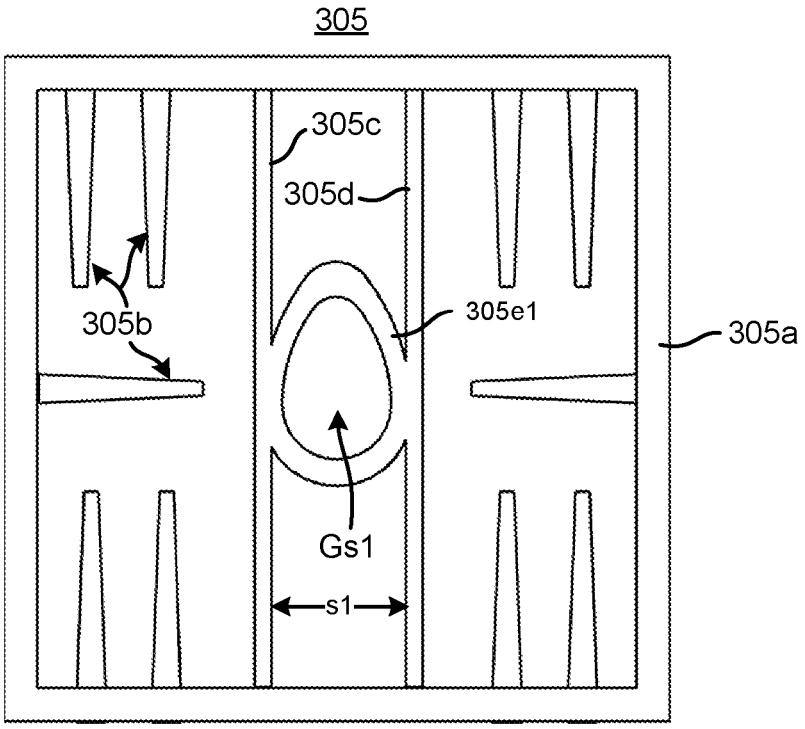
FIG. 10A-FIG. 10C illustrate a top, a front side, and a top perspective view, respectively, of the keyed safety burner grate having an egg-shaped keyed insert, according to another embodiment.
Figure 10B:
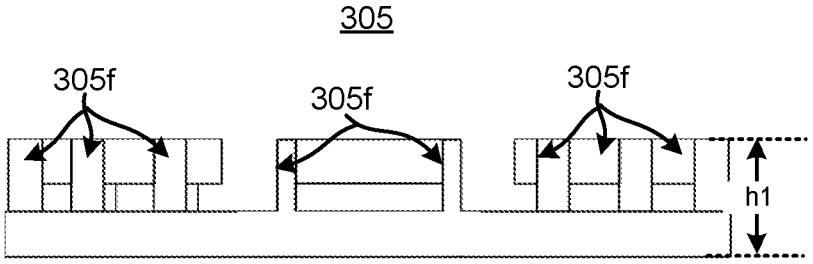
Figure 10C:
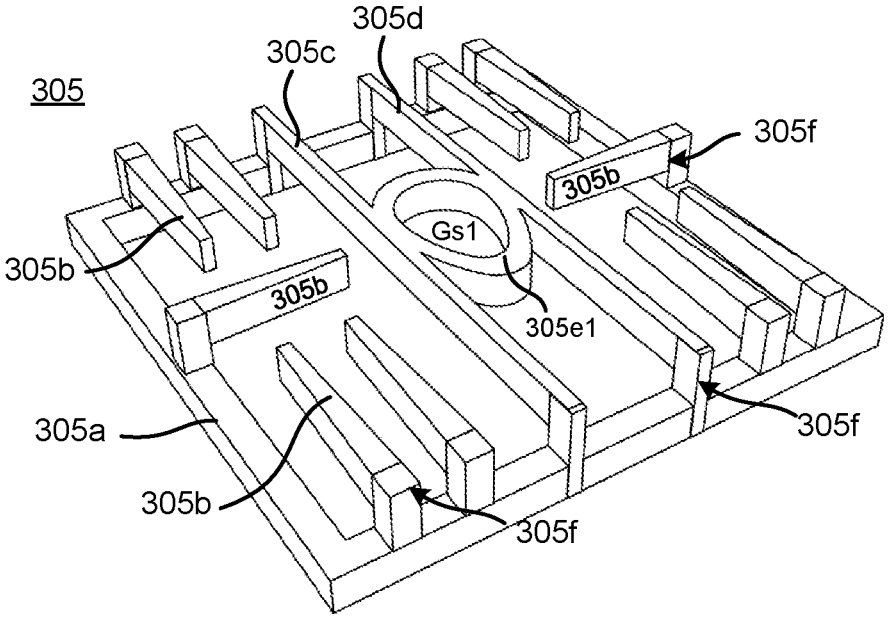

FIG. 10A-FIG. 10C illustrate a top, a front side, and a top perspective view, respectively, of the keyed safety burner grate 305 having an egg-shaped keyed insert Gs1, according to another embodiment. The keyed safety burner grate 305 in this embodiment includes similar elements to the previous embodiments where like numeral annotations are previously described. The differentiating elements in this embodiment include an egg-shaped grate locking component 305*e*1 having an egg-shaped slot Gs1 for receiving and mating with the egg-shaped keyed block member 303*b*1 of the keyed safety locking member 303. In operation, the method of inserting and locking the safety cookware device 300 to the keyed safety burner grate 305 using the egg-shaped keyed components (303*b*1, 305*e*1) is functionally the same as described in the previous embodiment and FIG. 7A—7B.

Figure 11B:
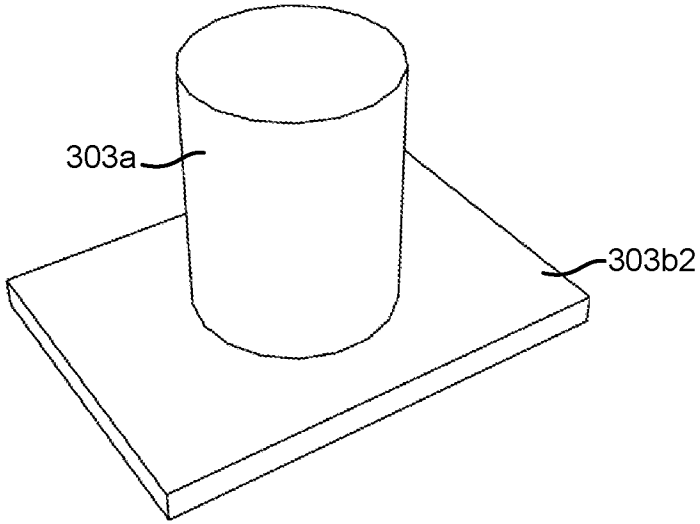
FIG. 11A-FIG. 11B illustrate a top and a top perspective view, respectively, of the keyed safety locking member having an rectangular-shaped keyed block member, according to another embodiment.
Figure 11A:
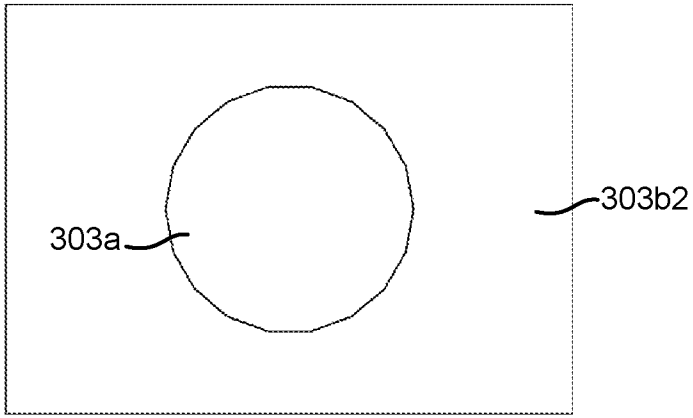

FIG. 11A-FIG. 11B illustrate a top and a top perspective view, respectively, of the keyed safety locking member 303 having an rectangular-shaped keyed block member 303*b*2, according to another embodiment. In this implementation, the safety locking member 303 may include the stem 303*a* coupled to the rectangular-shaped keyed block member 303*b*2. The stem 303*a* having one end portion connected to the safety cookware device 300 and another end portion connected to the rectangular-shaped keyed block member 303*b*1.

Figure 12A:
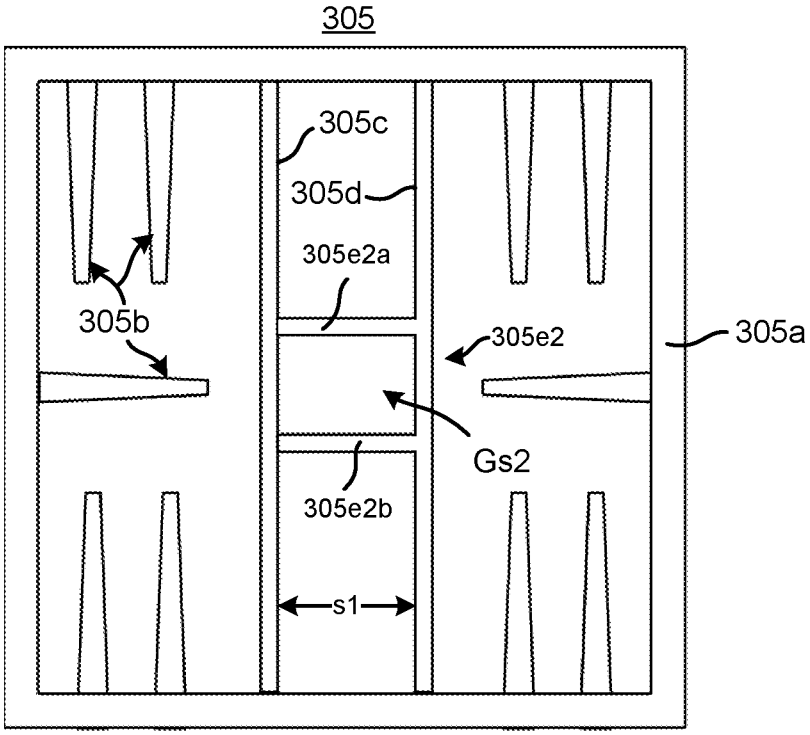
FIG. 12A-FIG. 12C illustrate a top, a front side, and a top perspective view, respectively, of the keyed safety burner grate having an rectangular-shaped keyed insert, according to another embodiment.
Figure 12B:
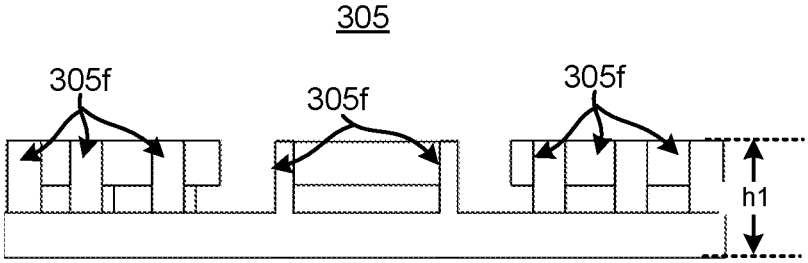
Figure 12C:
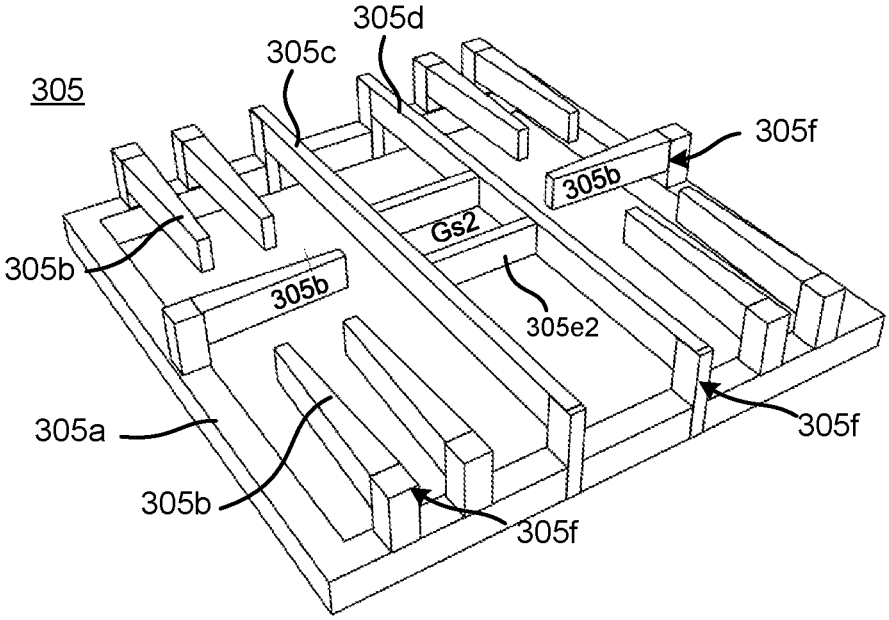

FIG. 12A-FIG. 12C illustrate a top, a front side, and a top perspective view, respectively, of the keyed safety burner grate 305 having an rectangular-shaped keyed insert Gs2, according to another embodiment. The keyed safety burner grate 305 in this embodiment includes similar elements to the previous embodiments where like numeral annotations are previously described. The differentiating elements in this embodiment include a rectangular-shaped grate locking component 305*e*2 having a rectangular-shaped slot Gs2 for receiving and mating with the egg-shaped keyed block member 303*b*2 of the keyed safety locking member 303. The rectangular-shaped grate locking component 305*e*2 includes two bars (305*e*2*a*, 305*e*2*b*) coupling a portion of the first rail member 305*c* and second rail member 305*d*. In operation, the method of inserting and locking the safety cookware device 300 to the keyed safety burner grate 305 using the egg-shaped keyed components (303*b*2, 305*e*2) is the same as described in the previous embodiment and FIG. 7A—7B.

Figure 13A:
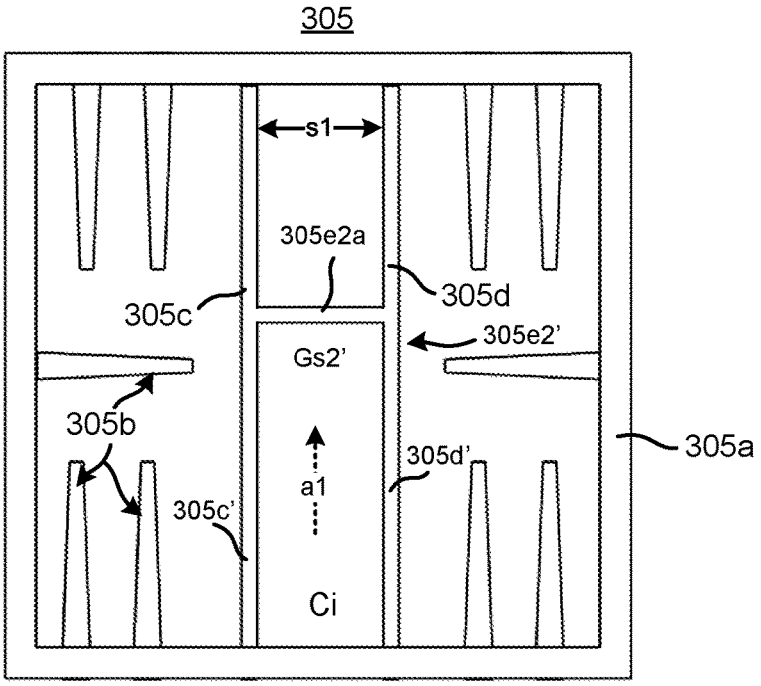
FIG. 13A-FIG. 13C illustrate a top, a front side, and a top perspective view, respectively, of the keyed safety burner grate having a channel insert slot, according to an embodiment.
Figure 13B:
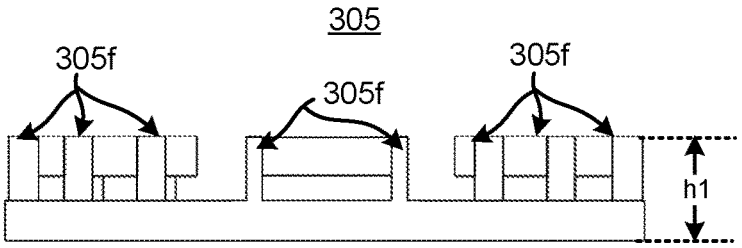
Figure 13C:
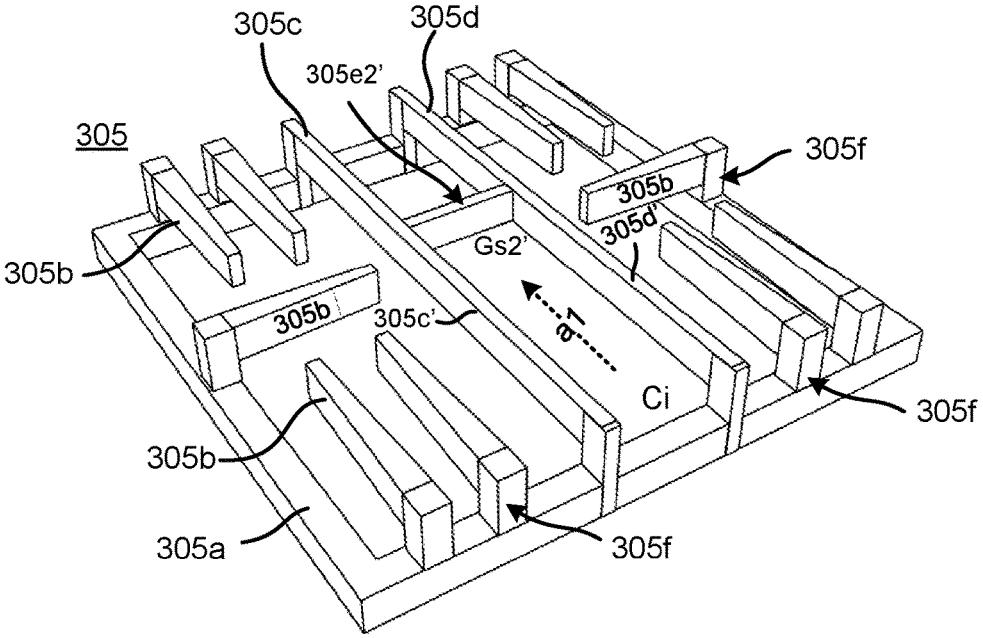
Figure 14B:
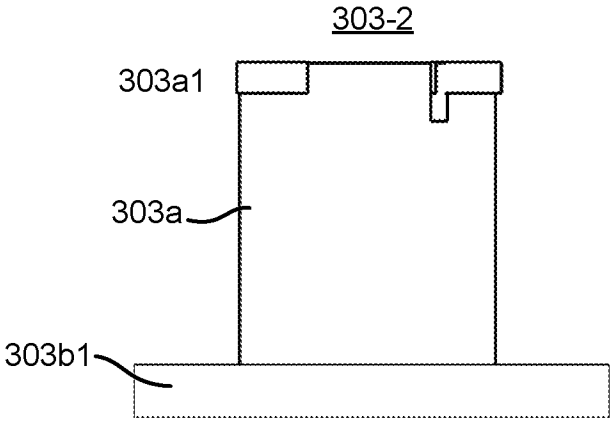
FIG. 14A-FIG. 14D illustrate multiple bottom perspective views of a removable twist lock safety member, according to another embodiment.
Figure 14D:
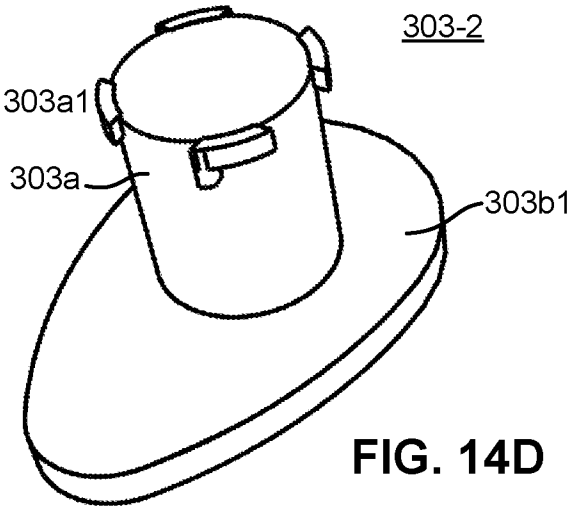
Figure 14A:
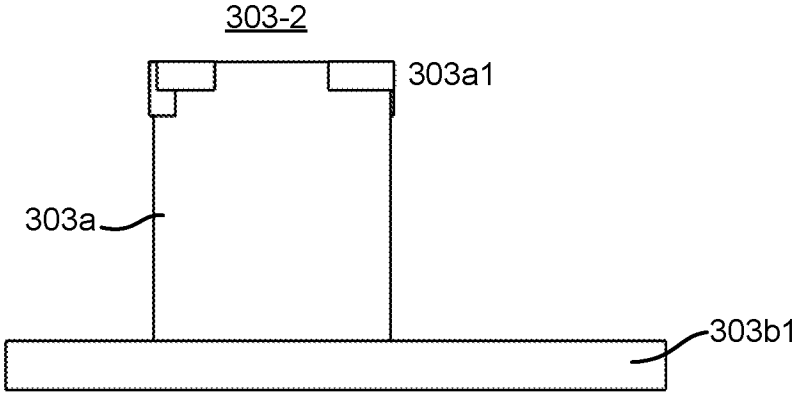
Figure 14C:
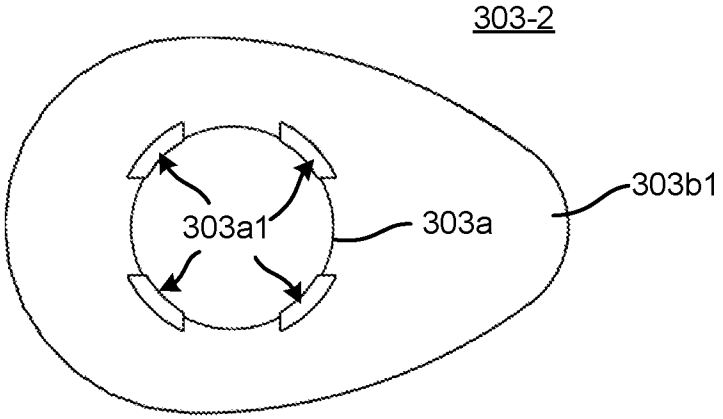

FIG. 13A-FIG. 13C illustrate a top, a front side, and a top perspective view, respectively, of the keyed safety burner grate 305 having a channel insert slot Ci, according to an embodiment. In the previous embodiment, the grate locking component 305*e*2 includes the two bars (305*e*2*a*, 305*e*2*b*) coupling the first rail member 305*c* and the second rail member 305*d*. In this embodiment, the grate locking component 305*e*2' only includes the single bar 305*e*2*a* acting as a channel stop. Portions of the channel stop 305*e*2*a*, the first open-ended rail member 305*c*', and the second open-ended rail member 305*d*' define the channel insert slot Ci as shown in FIG. 13A and FIG. 13C. In practice, the safety locking member 303 of the safety cookware device 300 may be directly inserted into the channel insert slot Ci, sliding the safety locking member 303 in a forward direction a1 and stopping at the channel stop 305*e*2*a* to engage with a portion of the channel stop 305*e*2*a*, a portion of the first open-ended rail member 305*c*', and a portion of the second open-ended rail member 305*d*'.

FIG. 14A-FIG. 14D illustrate multiple bottom perspective views of a removable twist lock safety member 303-2, according to another embodiment. The removable twist lock safety member 303-2 may include the keyed block member 303*b*1 and the stem 303*a* having protruding locking members 303*a*1 attached along a top edge portion of the stem 303*a*. In one implementation, protruding locking members 303*a*1 may include two or more protruding locking members 303*a*1 which are evenly or unevenly distributed along the stem 303*a*. Each protruding locking member 303*a*1 may have the same shape and structure or may include different shapes and structures. Examples of some protruding locking members include small bars, rods, truncated cylinders or a combination of varying shapes. In application, protruding locking members 303*a*1 are keyed and act as a male component that is configured to match and mate with a complementary female component which is disposed on a bottom portion of the safety cookware device 300 as described herein below.

Figure 15B:
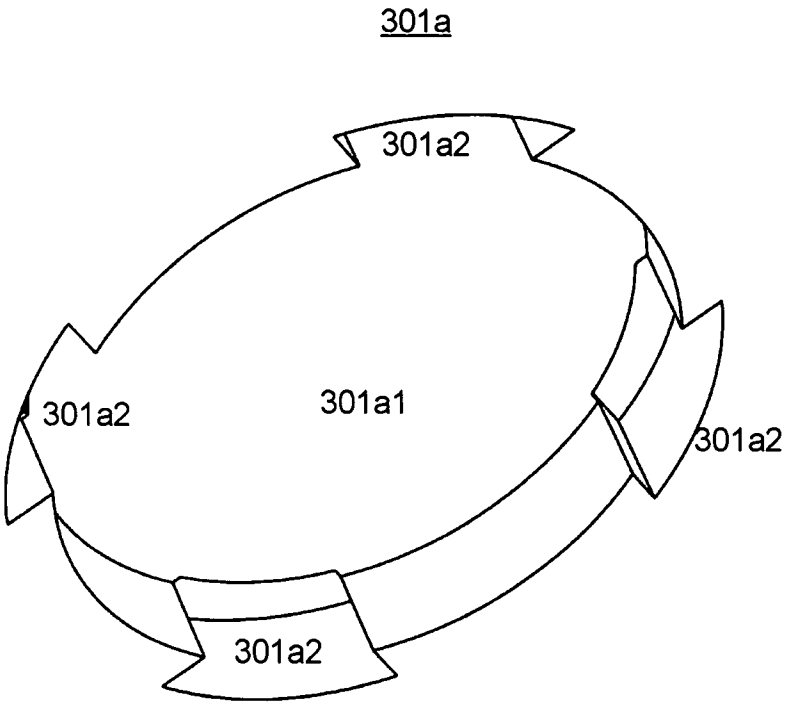
FIG. 15A-FIG. 15B illustrate two bottom perspective views of a female locking safety member which is disposed on the bottom portion of the safety cookware device, according to another embodiment.
Figure 15A:
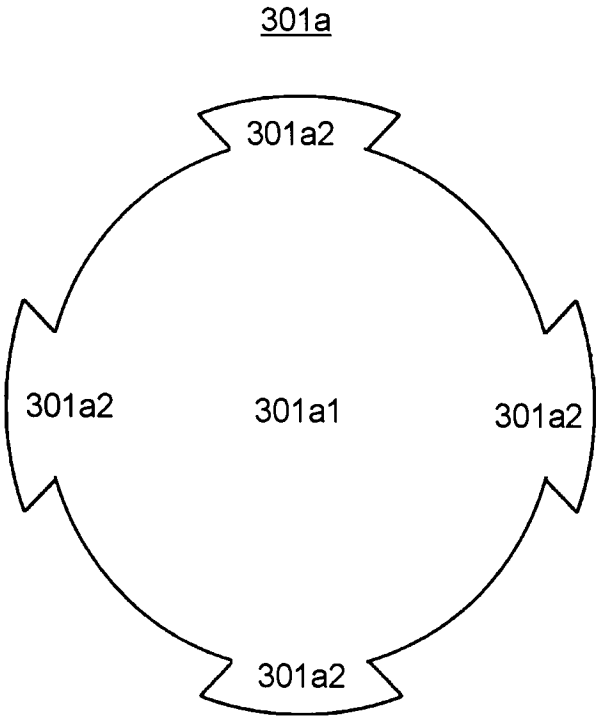

FIG. 15A-FIG. 15B illustrate two bottom perspective views of a female locking safety member 301*a* which is disposed on the bottom portion of the safety cookware device 300, according to another embodiment. The female locking safety member 301*a* may include a circular slot 301*a*1 having one or more channel members 301*a*2 which are evenly or unevenly distributed along the circular slot 301*a*1. Each channel members 301*a*2 may have the same shape and structure or may include different shapes and structures that are complementary to the protruding locking members 303*a*1.

Figure 16A:
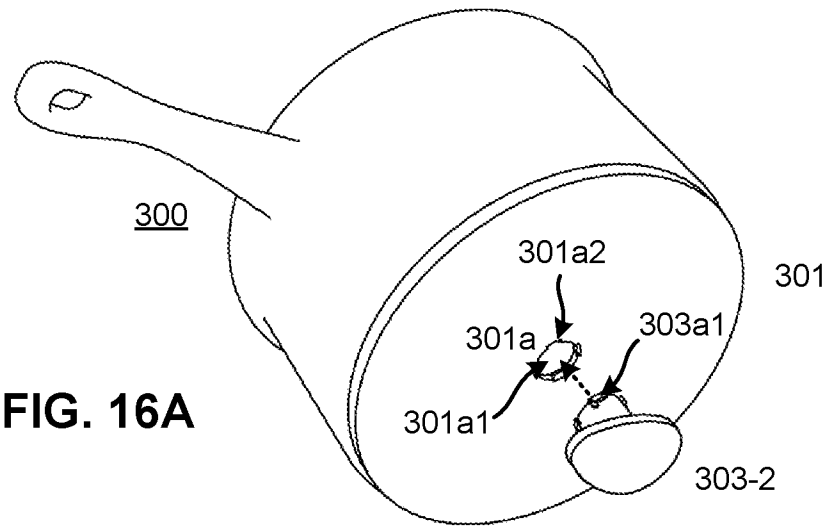
FIG. 16A-FIG. 16C illustrate multiple bottom perspective views of attaching and locking the removable twist lock safety member into the female locking safety member of the safety cookware device, according to another embodiment.
Figure 16B:
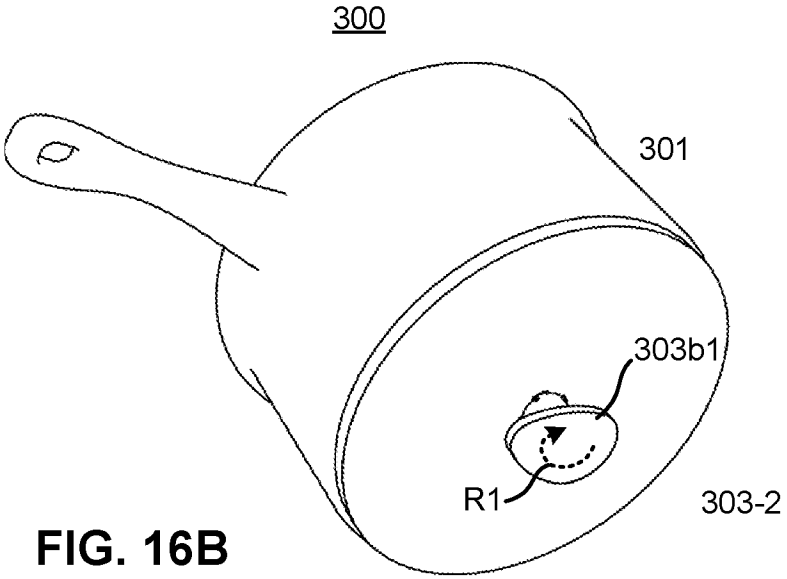
Figure 16C:
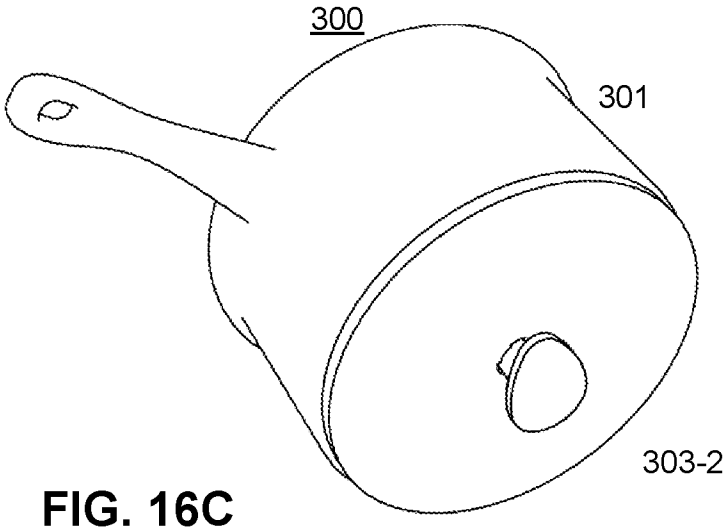

FIG. 16A-FIG. 16C illustrate multiple bottom perspective views of attaching and locking the removable twist lock safety member 303-2 into the female locking safety member 301*a* of the safety cookware device 300, according to another embodiment. In FIG. 16A, the protruding locking members 303*a*1 of the removable twist lock safety member 303-2 are first aligned with the complementary channel members 301*a*2 of the safety cookware device 300 and then inserted into the circular slot 301*a*1 as shown (dotted arrow). In FIG. 16B, the keyed block member 303*b*1 is then rotated in a clockwise R1 (or counter-clockwise) direction until it is locked into place and secured to the safety cookware device 300 as shown in FIG. 16C. The method of unlocking and removing the removable twist lock safety member 303-2 from the female locking safety member 301*a* is performed in a likewise manner but in reverse order.

Figure 17C:
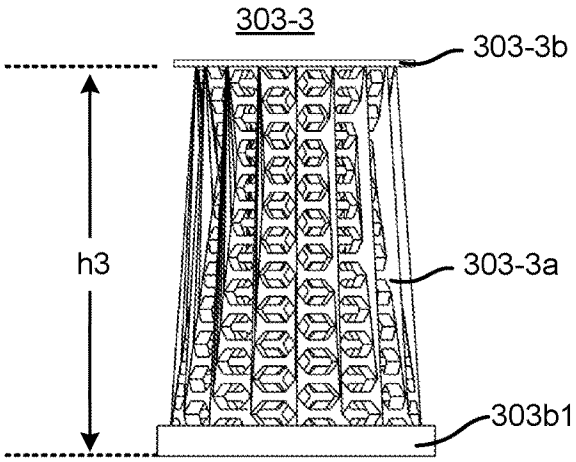
FIG. 17A-FIG. 17D illustrate side perspective views of a collapsible and expandable stem assembly, according to another embodiment.
Figure 17D:
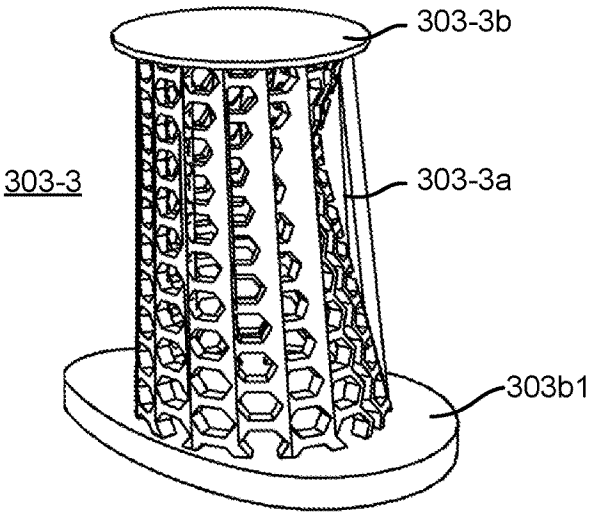
Figure 17A:
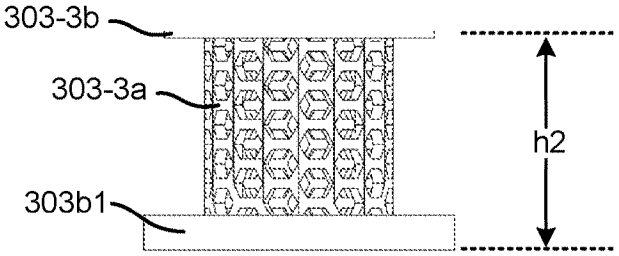
Figure 17B:
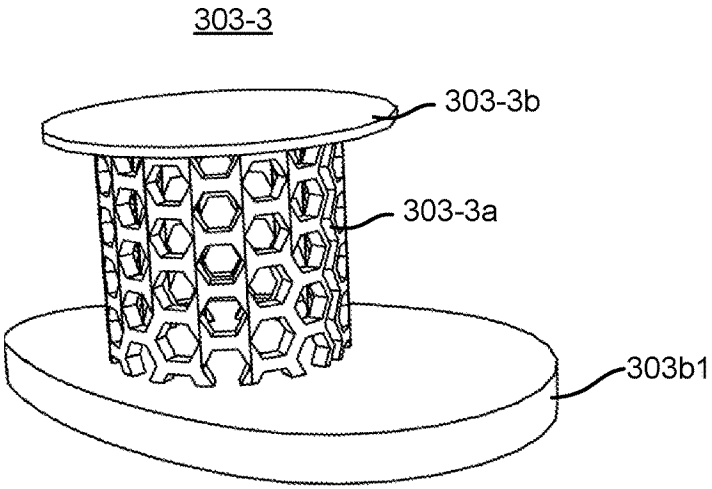

FIG. 17A-FIG. 17D illustrate side perspective views of a collapsible and expandable stem assembly 303-3, according to another embodiment. The collapsible and expandable stem assembly 303-3 may include a retractable member 303-3*a* such as, for example, a mesh-like structure coupling the keyed block member 303*b*1 to a cookware attachment member 303-3*b* that is attached to the bottom portion of the safety cookware device 300. The mesh tubing may be made from metal or high heat resistant material and/or other non-flammable material. In operation, the collapsible and expandable stem assembly 303-3 may be compressed to a shortened state h2 as shown in FIG. 17A and FIG. 17B or expanded to an elongated state h3 as shown in FIG. 17C and FIG. 17D. In practice, the collapsible and expandable stem assembly 303-3 may have the additional benefit of allowing the safety cookware device 300 to lay relatively flat on a tabletop or countertop surface while allowing it to expand, engage and lock into the grate locking component 305*e* of the grate 305.

Figure 18C:
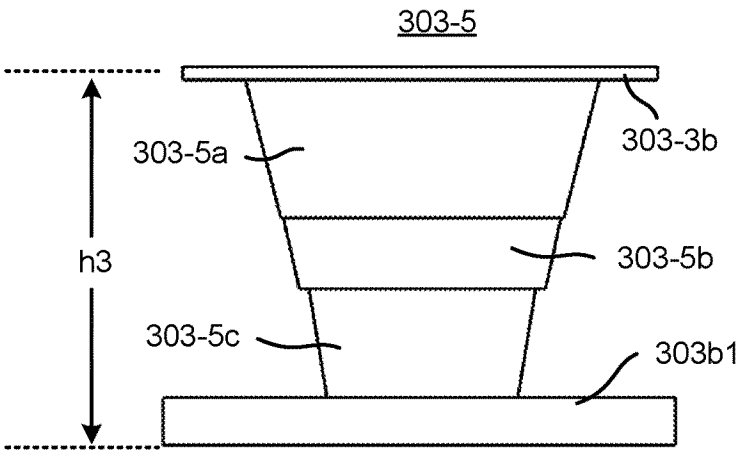
FIG. 18A-FIG. 18D illustrate side perspective views of another collapsible and expandable stem assembly, according to another embodiment.
Figure 18D:
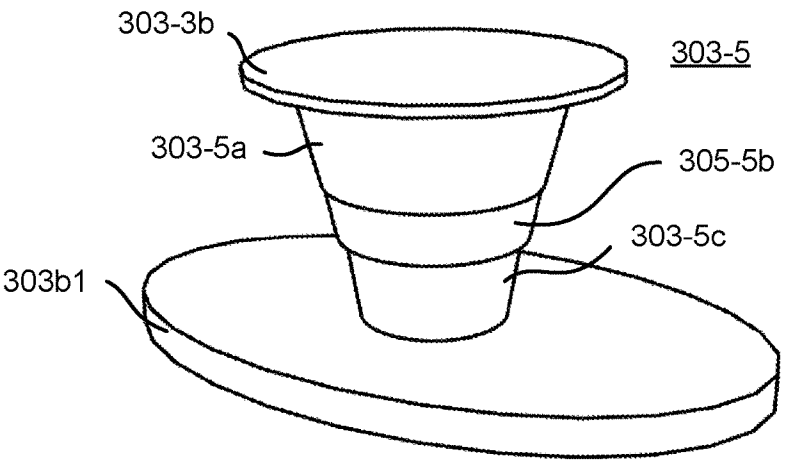
Figure 18A:
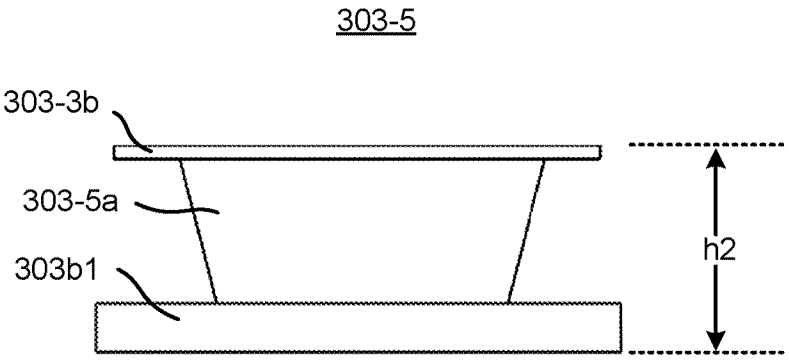
Figure 18B:
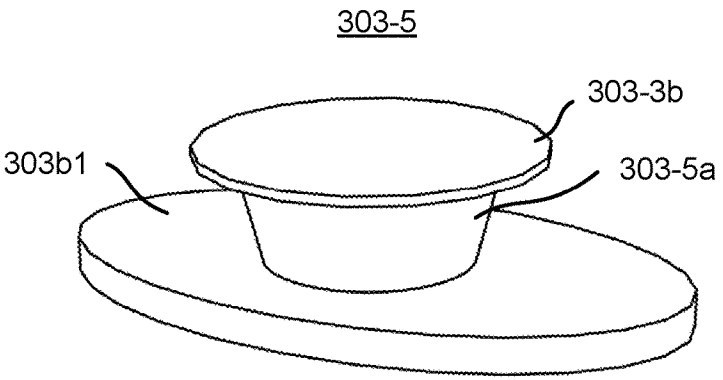

FIG. 18A-FIG. 18D illustrate side perspective views of another collapsible and expandable stem assembly 303-5, according to another embodiment. In this embodiment, the collapsible and expandable stem assembly 303-5 may include another type of retractable member having retractable cones (303-5*a*, 303-5*b*, 303-5*c*) coupling the keyed block member 303*b*1 to the cookware attachment member 303-3*b*. The collapsible and expandable stem assembly 303-5 may include tapered cylinders made from metal or high heat resistant material and/or other non-flammable material. In practice, the retractable cones (303-5*a*, 303-5*b*, 303-5*c*) may be compressed to a shortened state h2 as shown in FIG. 18A and FIG. 18B or expanded to an elongated state h3 as shown in FIG. 18C and FIG. 18D. As in the previous embodiment, the collapsible and expandable stem assembly 303-5 may have the additional benefit of allowing the safety cookware device 300 to lay flat on a tabletop or countertop surface while still allowing it to expand, engage and lock into the grate locking component 305*e* of the grate 305.

Figure 19C:
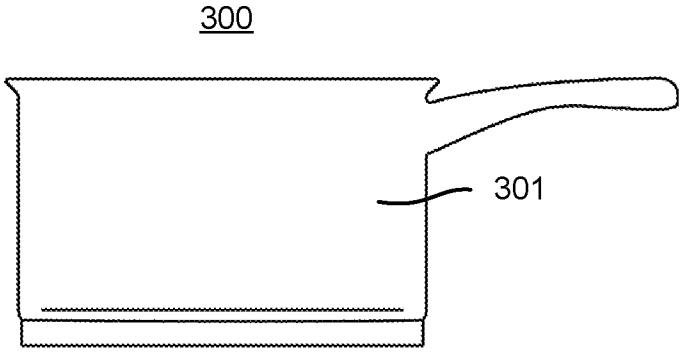
FIG. 19A-FIG. 19D illustrate multiple side and perspective views of an application and use of the collapsible and expandable stem assembly with the safety cookware device, according to another embodiment.
Figure 19D:
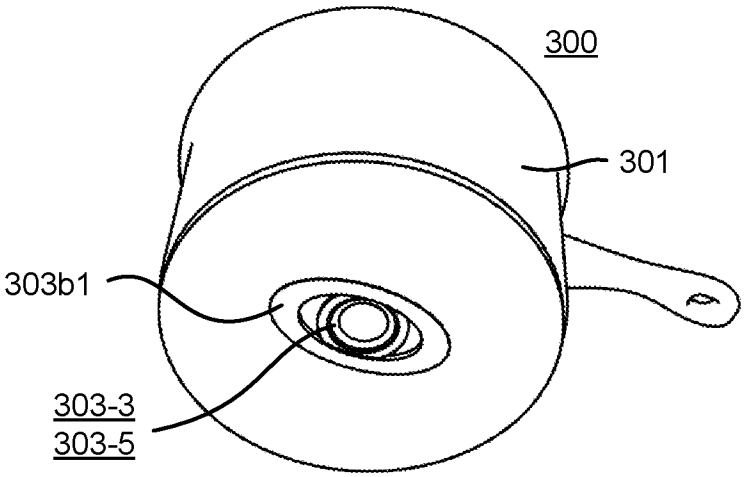
Figure 19A:
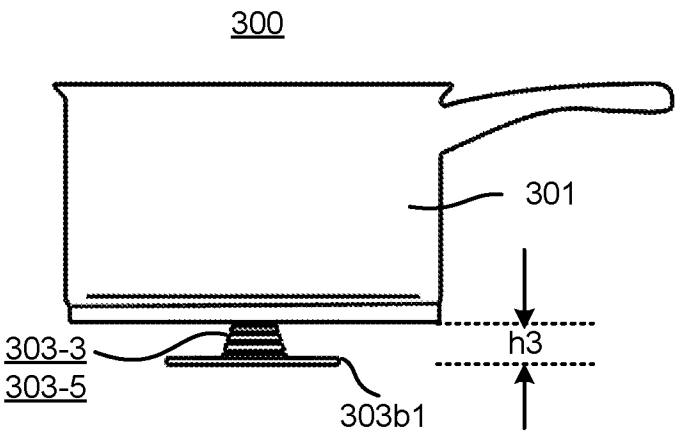
Figure 19B:
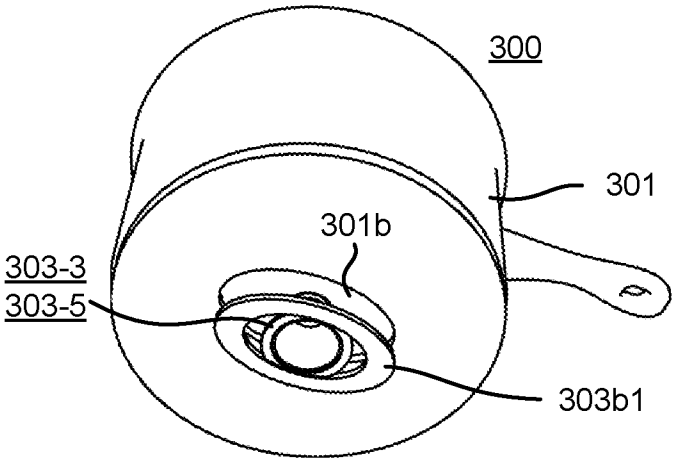

FIG. 19A-FIG. 19D illustrate multiple side and perspective views of an application and use of the collapsible and expandable stem assembly (303-3, 303-5) with the safety cookware device 300, according to another embodiment. The safety cookware device 300 may include a recessed keyed block insert slot 301*b* disposed on a bottom middle portion of the heated cookware appliance 301 (e.g., pot or pan) as shown in FIG. 19B. In the extended position, the collapsible and expandable stem assembly (303-3, 303-5) is fully expanded, extending beyond the bottom portion the cookware 301 at a height distance h2 as shown in FIG. 19A. In the collapsed position, the collapsible and expandable stem assembly (303-3, 303-5) is fully collapsed, retracting below and into the recessed keyed block insert slot 301*b* of the heated cookware appliance 301 as shown in FIG. 19C and FIG. 19D. In practice, the collapsible and expandable stem assembly 303-5 may allow the safety cookware device 300 to lay flat on a tabletop or countertop surface when fully collapsed and engage and lock into the grate locking component 305*e* when fully expanded.

Figure 20B:
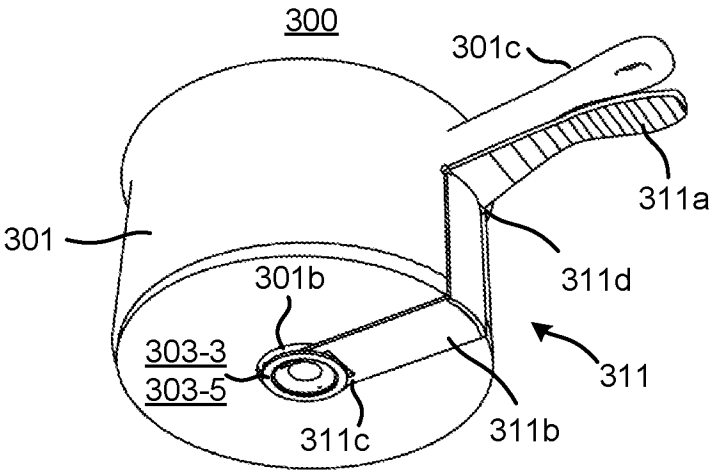
FIG. 20A-FIG. 20D illustrate multiple side and perspective views of the safety cookware device having a stem release and lock lever for collapsing and expanding the stem assembly, according to another embodiment.
Figure 20D:
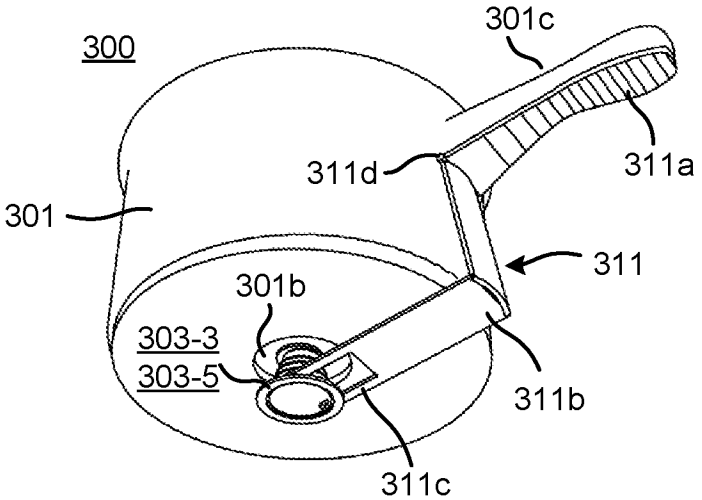
Figure 20A:
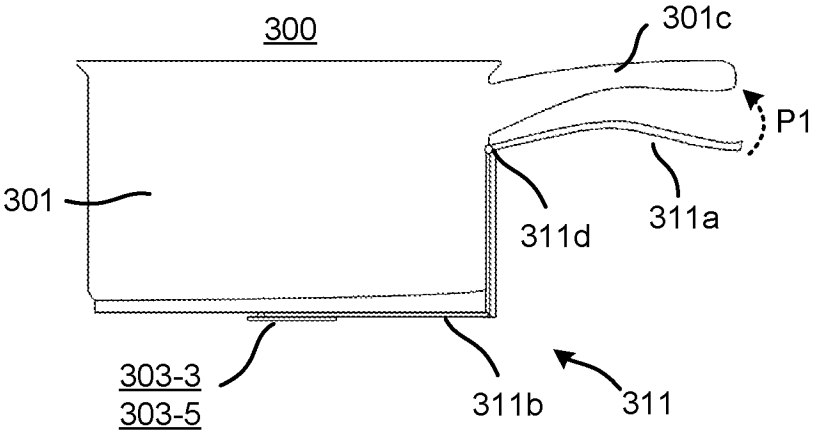
Figure 20C:
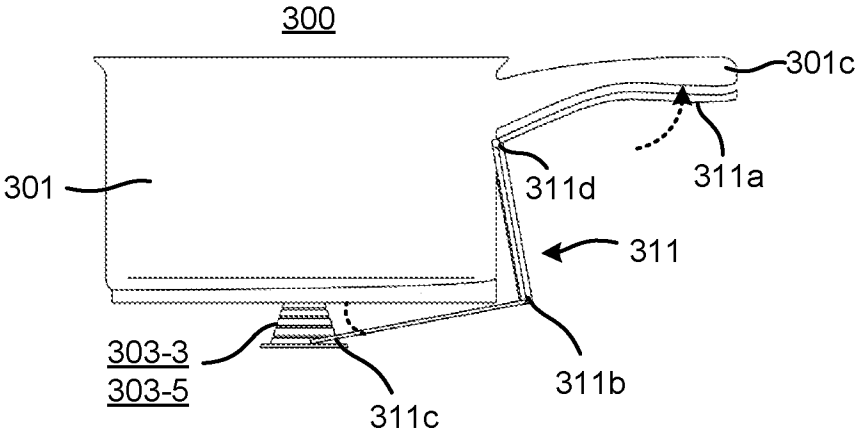

FIG. 20A-FIG. 20D illustrate multiple side and perspective views of the safety cookware device 300 having a stem release and lock lever 311 for collapsing and expanding the stem assembly (303-3, 303-5), according to another embodiment. The stem release and lock lever 311 may include a stem handle 311*a*, a rigid L-shaped lever arm member 311*b* coupled to the handle at a first end of the rigid L-shaped lever arm member 311*b*, and stem release mechanism 311*c* coupled to a second end of the rigid L-shaped lever arm member 311*b*. The stem release and lock lever 311 may further include a pin and spring assembly 311*d* disposed between the stem handle 311*a* and the rigid L-shaped lever arm member 311*b*, acting as pivot point. The pin and spring assembly 311*d* may further be attached to the heated cookware appliance 301 (e.g., pot or pan) via a hinge having eyelets or knuckles to secure a portion of the stem release and lock lever 311 to the heated cookware appliance 301. In practice, the stem release and lock lever 311 may collapse and expand the stem assembly (303-3, 303-5) in either a collapsed state as shown in FIG. 20A and FIG. 20B, or an expanded state as shown in FIG. 20C and FIG. 20D. In the collapsed state, the stem handle 311*a* and the handle 301*c* of the cookware 301 are in its natural state with no pressure applied to either handles by the user as shown in FIG. 20A and FIG. 20B. In the expanded state, the user may squeeze P1 the stem handle 311*a* towards the handle 301*c* of the heated cookware appliance 301, causing the stem release mechanism 311*c* of the rigid L-shaped lever arm member 311*b* to eject and fully expand the stem assembly (303-3, 303-5) from the keyed block insert slot 301*b* of the cookware 301. In practice, the stem release and lock lever 311 provides the user a comfortable and easy way to the collapse and expand the stem assembly 303-3/303-5 from the safety cookware device 300, allowing it to lay flat on a tabletop or countertop surface when fully collapsed and engage and lock into the grate locking component 305*e* when fully expanded. In other implementations, other types of retractable members may be applied such as a folding wire cage, folding plates, or a spring.

Figure 21B:
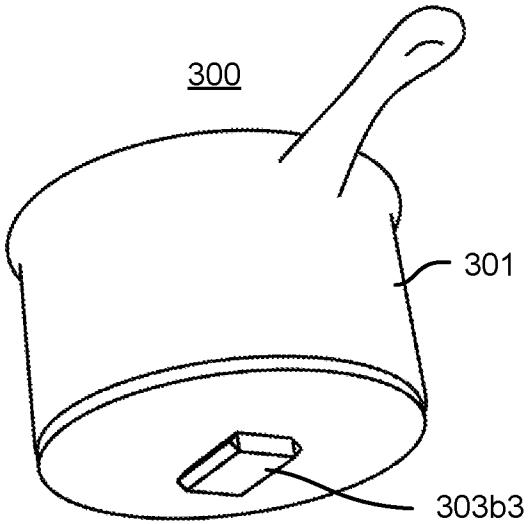
FIG. 21A-FIG. 21B illustrate a side view and perspective view of the safety cookware device having components for a tongue and groove interlocking assembly, according to another embodiment.
Figure 21A:
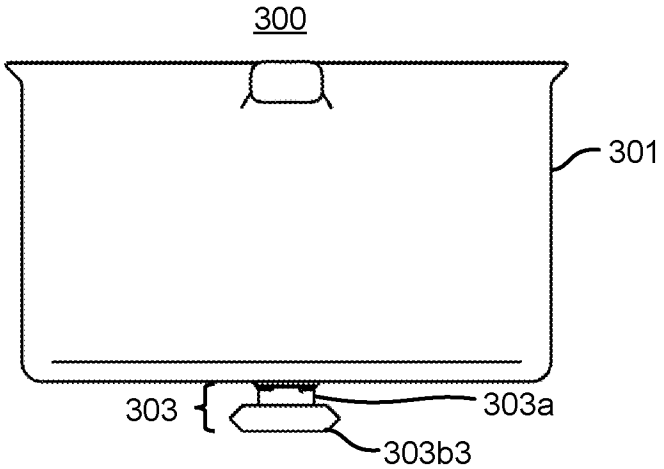

FIG. 21A-FIG. 21B illustrate a side view and perspective view of the safety cookware device 300 having components for a tongue and groove interlocking assembly, according to another embodiment. For the safety cookware device 300, the safety locking member 303 may include the stem 303*a* that is coupled to a keyed block member 303*b*3 having an elongated rhombus shaped profile providing the tongue component (or male members) for the tongue and groove interlocking assembly.

Figure 22B:
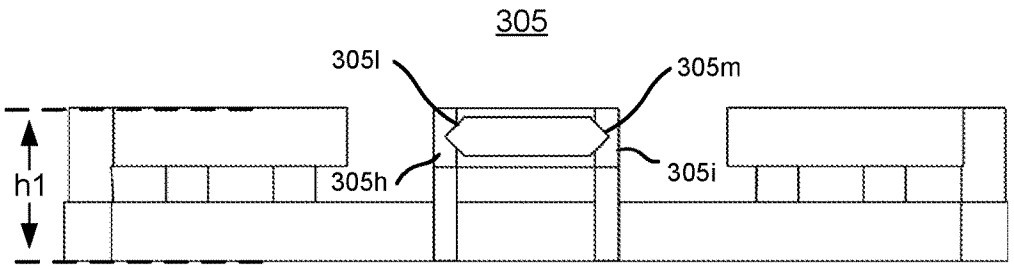
FIG. 22A-FIG. 22C illustrate a top view, a cross-sectional view, and front perspective view, respectively, of the keyed safety burner grate having components for the tongue and groove interlocking assembly, according to another embodiment.
Figure 22A:
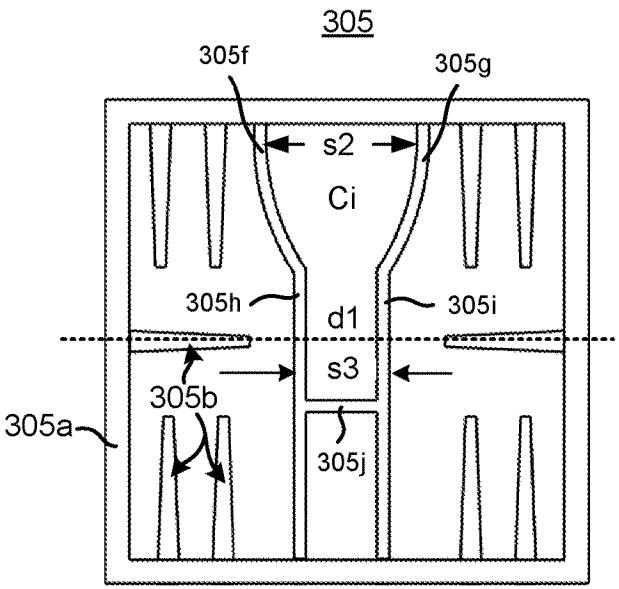
Figure 22C:
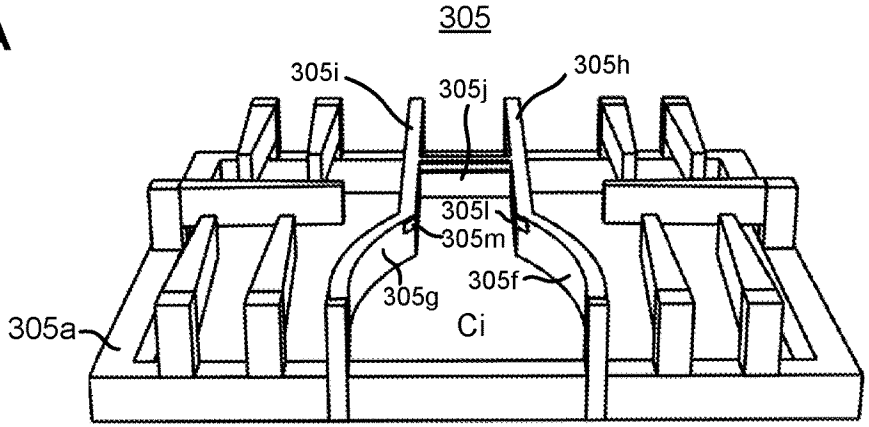

FIG. 22A-FIG. 22C illustrate a top view, a cross-sectional view, and front perspective view, respectively, of the keyed safety burner grate 305 having components for the tongue and groove interlocking assembly, according to another embodiment. In this implementation, the keyed safety burner grate 305 may include a channel insert slot Ci formed by two insert guide rail members 305*f* and 305*g* separated by a first fixed distance s2 as shown in FIGS. 22A and 22C. The two guide rail members 305*f* and 305*g* may be curvilinear, forming a wine glass shaped channel insert slot Ci, where the two insert guide rail members 305*f* and 305*g* are widest apart at the edge of the outer frame 305*a* and gradually narrows and connects to a grate locking component formed by two stem guide rails (305*h*, 305*i*) and a channel stop 305*j*. The two stem guide rails (305*h*, 305*i*) are separated by a second fixed distance s3 and generally run parallel to one another, both connecting to the outer frame 305*a* as shown in FIG. 22A. A cross-sectional view of the two stem guide rails (305*h*, 305*i*) along dl of FIG. 22A is shown in FIG. 22B. In FIG. 22B, grooves (3051, 305*m*) are formed along each stem guide rails (305*h*, 305*i*) and are configured to match and mate with the keyed block member 303*b*3 having the elongated rhombus shaped profile.

Figure 23A:
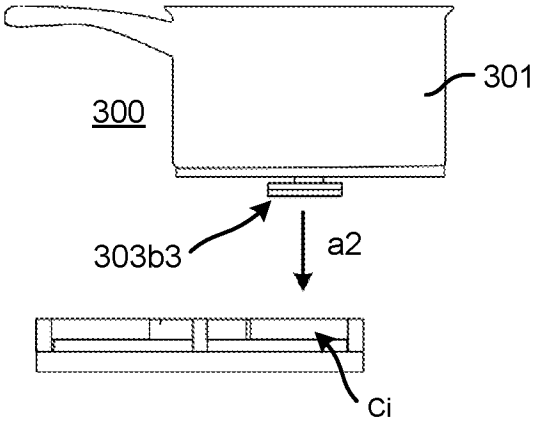
FIG. 23A-FIG. 23F illustrate multiple side and perspective views showing a method of inserting the safety cookware device into the keyed safety burner grate having the tongue and groove interlocking assembly, according to another embodiment.
Figure 23B:
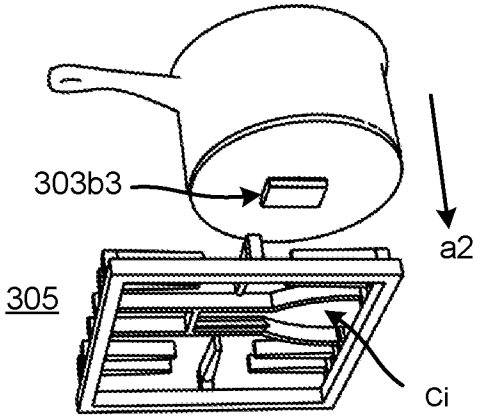
Figure 23C:
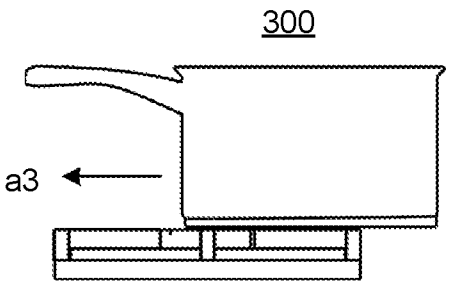
Figure 23D:
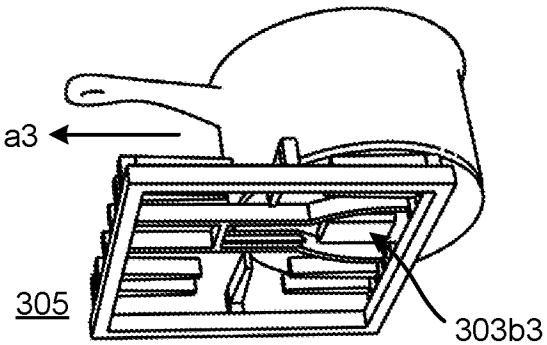
Figure 23E:
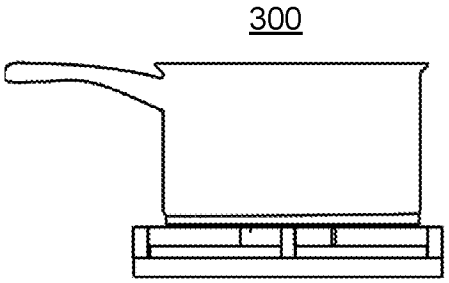
Figure 23F:
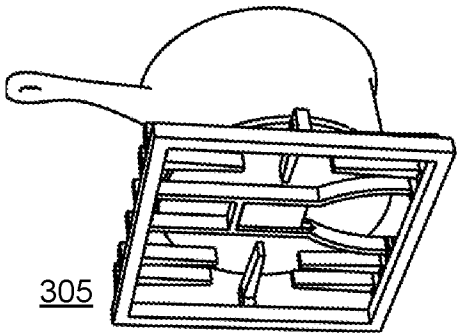

FIG. 23A-FIG. 23F illustrate multiple side and perspective views showing a method of inserting the safety cookware device 300 into the keyed safety burner grate 305 having the tongue and groove interlocking assembly, according to another embodiment. First, the user may hold the safety cookware device 300 raising it above the safety cookware device 300 and then aligning so that the keyed block member 303*b*3 is within the opening or mouth of the wine glass shaped channel insert slot Ci as shown in FIG. 23A and FIG. 23B. Once aligned, the safety cookware device 300 may be lowered (a2) so that the keyed block member 303*b*3 is inserted into the opening or mouth of the wine glass shaped channel insert slot Ci, resting on the surface of the keyed safety burner grate 305, as shown in FIG. 23C and FIG. 23D. Next, the safety cookware device 300 is pulled in a direction (a3) towards the grate locking component of the keyed safety burner grate 305 until the keyed block member 303*b*3 is mated and secured to grooves disposed on the two stem guide rails (305*h*, 305*i*), stopping at the channel stop 305*j*, as shown in FIG. 23E and FIG. 23F.

Figure 24B:
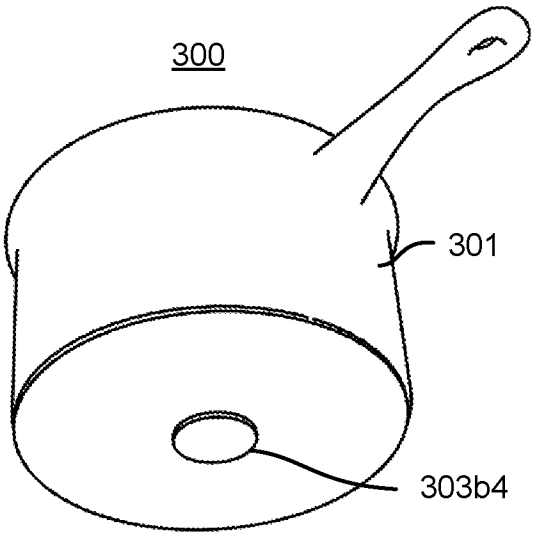
FIG. 24A-FIG. 24B illustrate a side view and perspective view of the safety cookware device having components for a disc interlocking assembly, according to another embodiment.
Figure 24A:
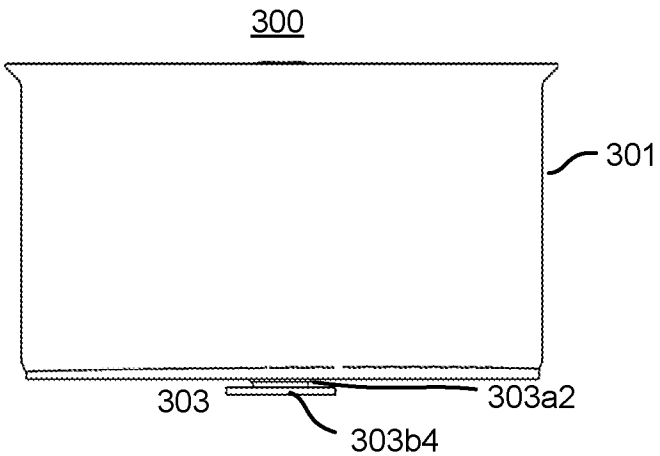

FIG. 24A-FIG. 24B illustrate a side view and perspective view of the safety cookware device 300 having components for a disc interlocking assembly, according to another embodiment. For the safety cookware device 300, the safety locking member 303 may include a thin stem 303*a*2 that is coupled to a keyed block member 303*b*4 having a disc plate, providing a first component (or male member) for the disc interlocking assembly as shown.

Figure 25B:
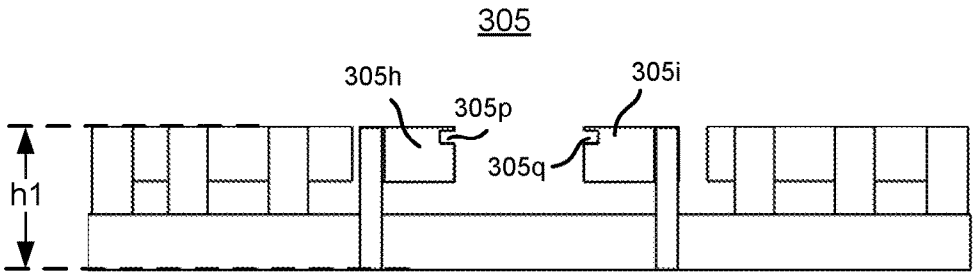
FIG. 25A-FIG. 25C illustrate a top view, a cross-sectional view, and front perspective view, respectively, of the keyed safety burner grate having components for the disc interlocking assembly, according to another embodiment.
Figure 25A:
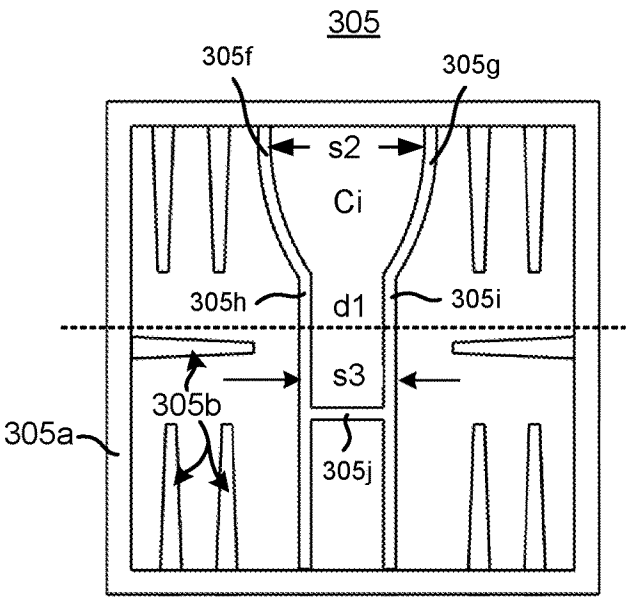
Figure 25C:
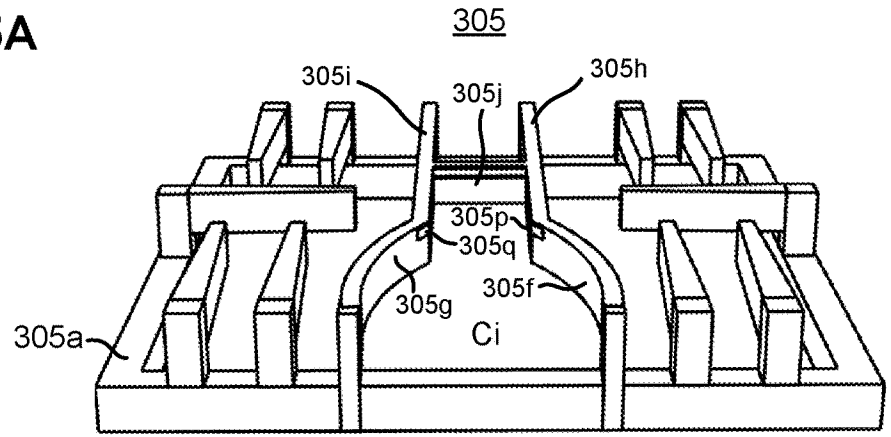

FIG. 25A-FIG. 25C illustrate a top view, a cross-sectional view, and front perspective view, respectively, of the keyed safety burner grate 305 having components for the disc interlocking assembly, according to another embodiment. In this implementation, the channel insert slot Ci formed by two insert guide rail members 305*f* and 305*g* separated by the fixed distance s2 as shown in FIG. 25A and FIG. 25C. The two insert guide rail members 305*f* and 305*g* may be curvilinear, forming the wine glass shaped channel insert slot Ci, where the two insert guide rail members 305*f* and 305*g* are widest apart at the edge of the outer frame 305*a* and gradually narrows and connects to a grate locking component formed by two stem guide rails (305*h*, 305*i*) and the channel stop 305*j*. The two stem guide rails (305*h*, 305*i*) are separated by the fixed distance s3 and generally run parallel to one another, both connecting to the outer frame 305*a* as shown in FIG. 22A. A cross-sectional view of the two stem guide rails (305*h*, 305*i*) along dl of FIG. 25A is shown in FIG. 25B. In FIG. 25B, rectangular slots (305*p*, 305*q*) are formed along each stem guide rails (305*h*, 305*i*) and are configured to match and mate with the disc shaped keyed block member 303*b*4.

Figure 26A:
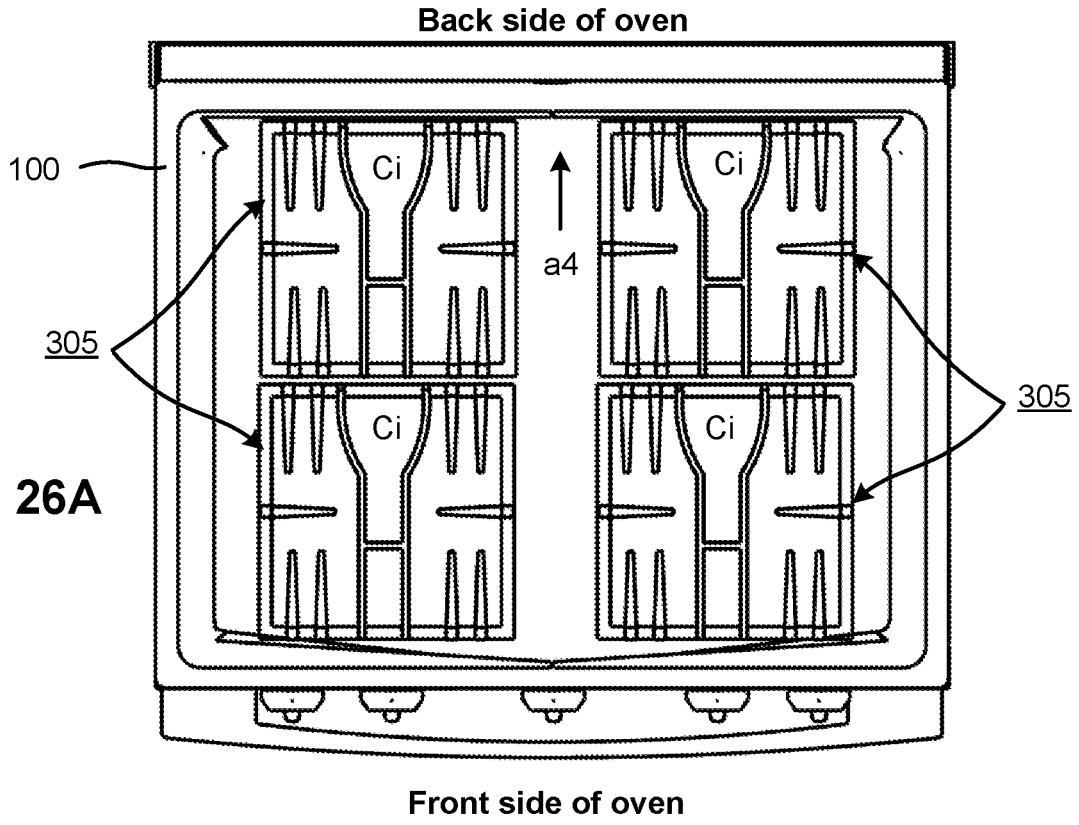
FIG. 26A-FIG. 26B illustrate a top view and top perspective view, respectively, of multiple keyed safety burner grates applied to the oven, according to another embodiment.
Figure 26B:
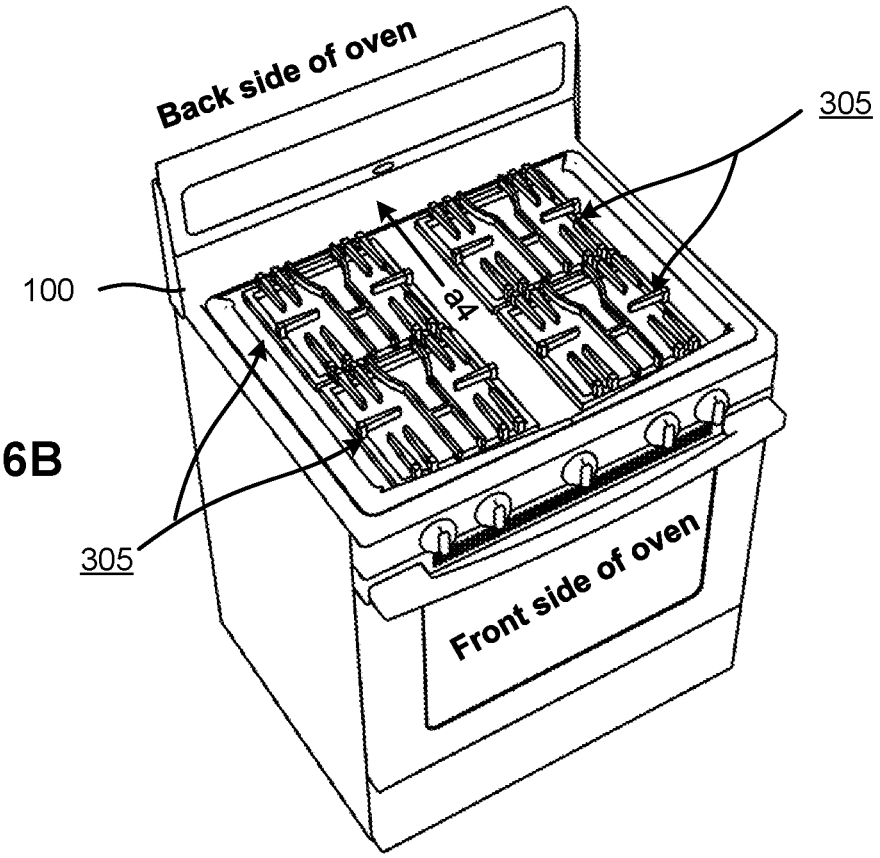

FIG. 26A-FIG. 26B illustrate a top view and top perspective view, respectively, of multiple keyed safety burner grates 305 applied to the oven 100, according to another embodiment. Each keyed safety burner grate 305 are placed onto the top surface of the oven 100 with the wine glass shaped channel insert slot Ci facing in a direction (a4) towards the back side of the oven as shown. In practice, having the wine glass shaped channel insert slot Ci facing the back side of the oven 100 will prevent the user from pulling the safety cookware device 300 off the keyed safety burner grate 305 once locked into place.

Figure 27:
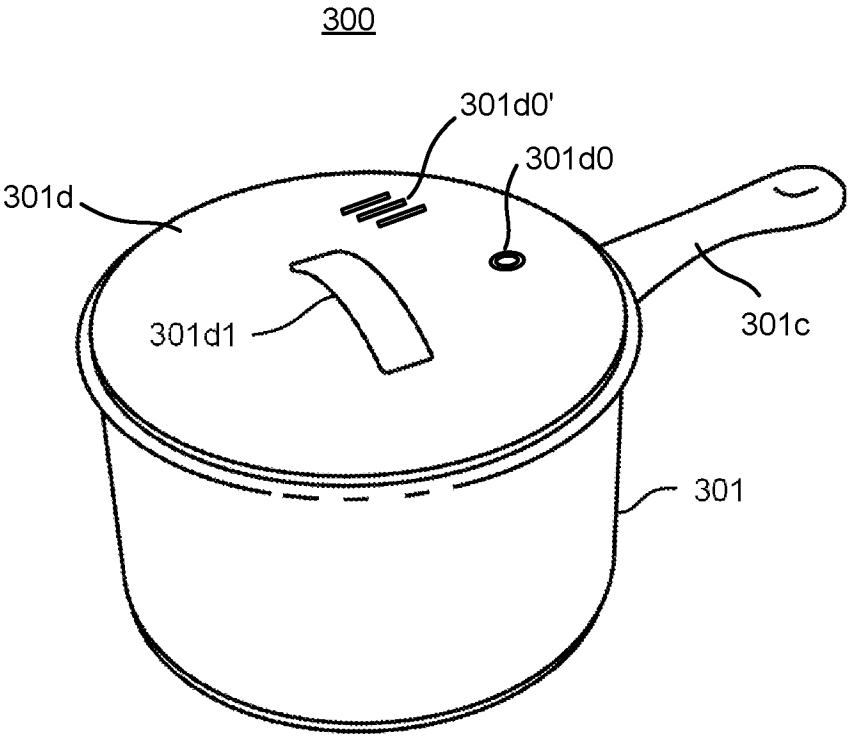
FIG. 27 illustrates a top perspective view of the safety cookware device having a twist lock lid member, according to another embodiment.
Figure 28B:
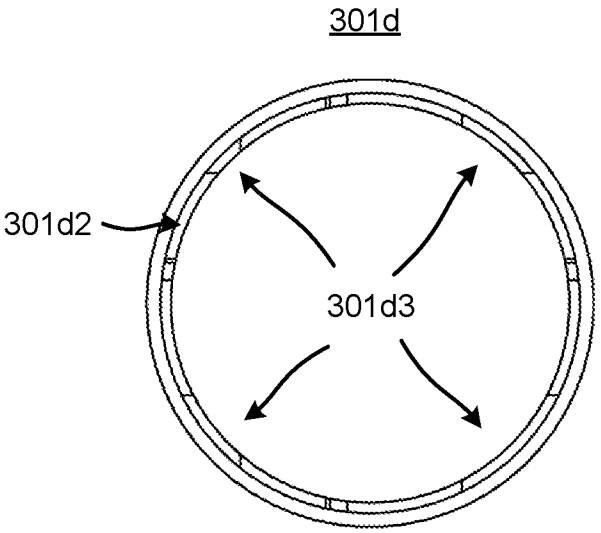
FIG. 28A-FIG. 28D illustrate multiple views of the twist lock lid member and lid locking component thereof, according to another embodiment.
Figure 28D:
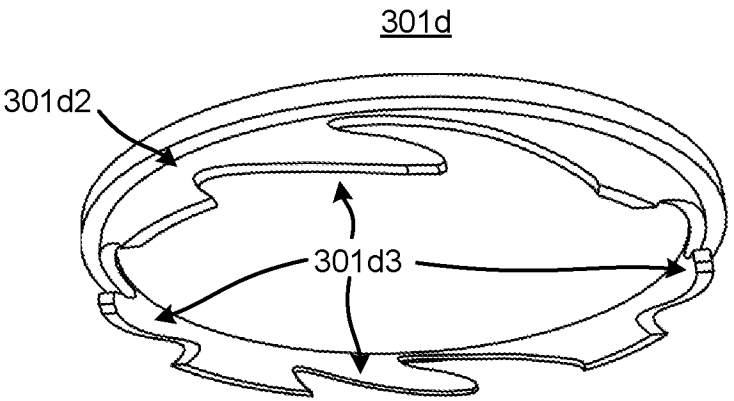
Figure 28A:
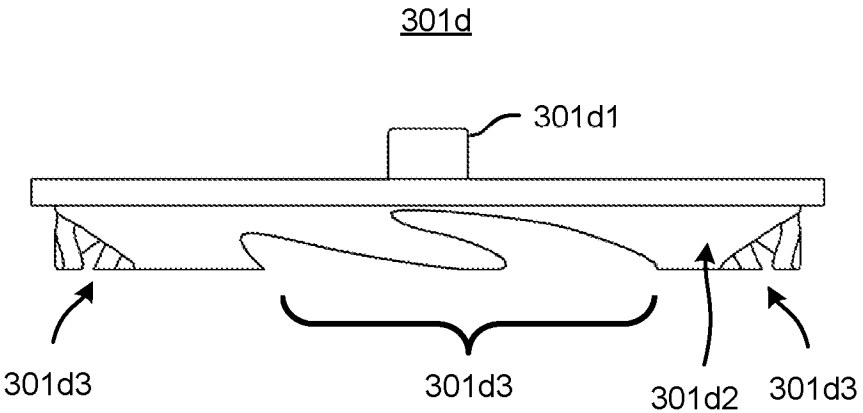
Figure 28C:
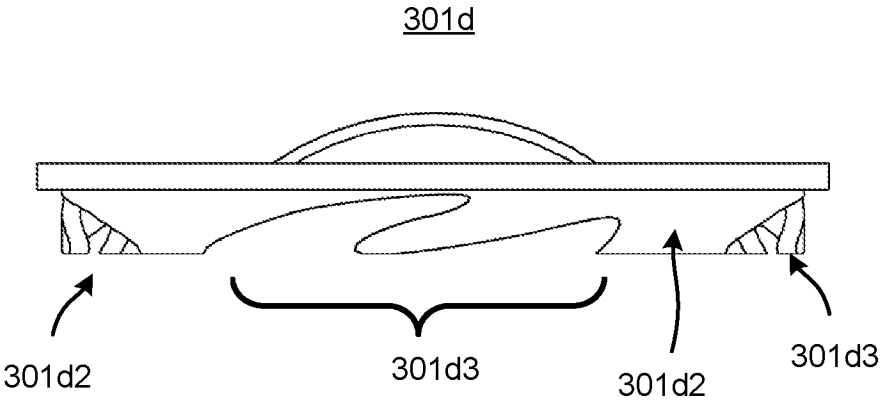

FIG. 27 illustrates a top perspective view of the safety cookware device 300 having a twist lock lid member 301*d*, according to another embodiment. The having a twist lock lid member 301*d* may include a lid handle 301*d*1 attached to a top center portion of the member 301*d*, allowing the user to removing and attaching the lid member 301*d* to the heated cookware appliance 301 as well as twisting or rotating the lid member 301*d* to lock and unlock it to the heated cookware appliance 301 as describe herein below. The having a twist lock lid member 301*d* may also include a pressure release vent within the twist lock lid member 301*d* for releasing pressure when the twist lock lid member 301*d* is locked to the to the heated cookware appliance 301 during cooking. The pressure release vent may include, for example, a small circular hole 301*d*0 or one or more slots 301*d*0' as shown in FIG. 27.

FIG. 28A-FIG. 28D illustrate multiple views of the twist lock lid member 301*d* and lid locking component thereof, according to another embodiment. The twist lock lid member 301*d* may include a tubular locking body 301*d*2 disposed below the twist lock lid member 301*d*, having twist-lock grooves 301*d*3 evenly distributed along sidewall sections of the tubular locking body 301*d*2 as shown. The twist-lock grooves 301*d*3 may be of any shape and pattern that is suitable for interlocking with complementary shapes and patterns used in twisting or rotation locking applications.

Figure 29B:
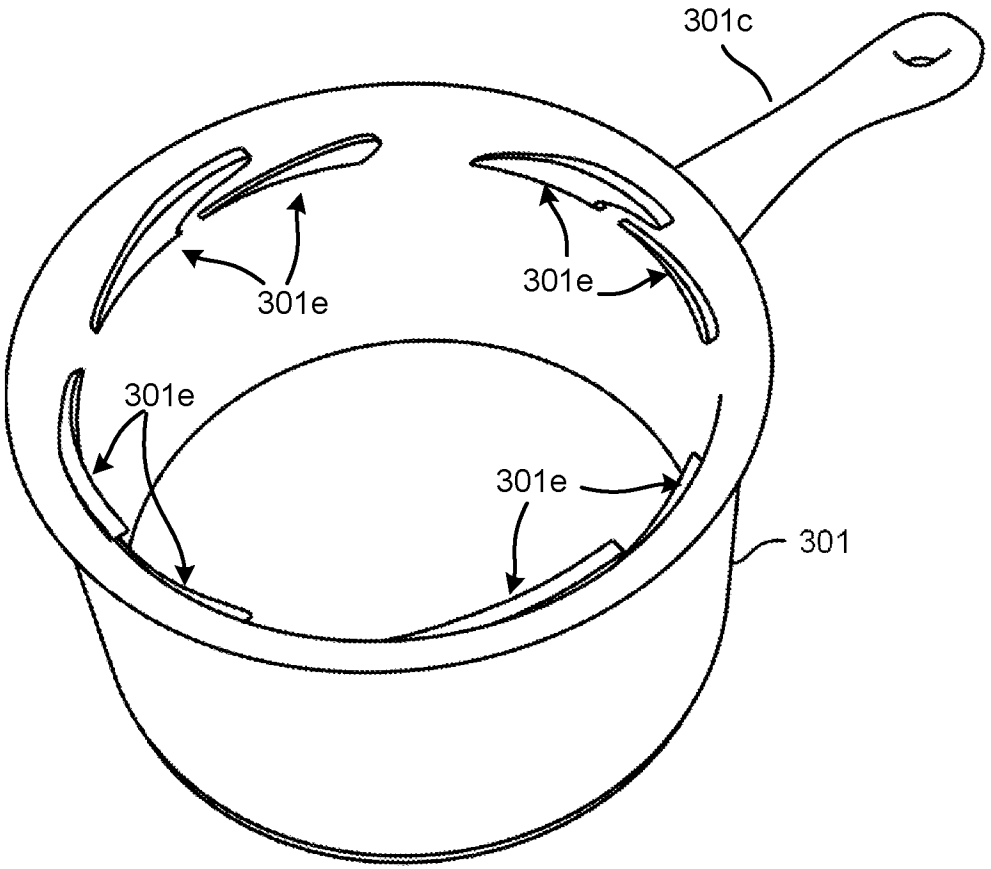
FIG. 29A-FIG. 29B illustrate the heated cookware appliance having twist-lock receiving members evenly distributed along a top inner sidewall portion of the heated cookware appliance, according to another embodiment.
Figure 29A:
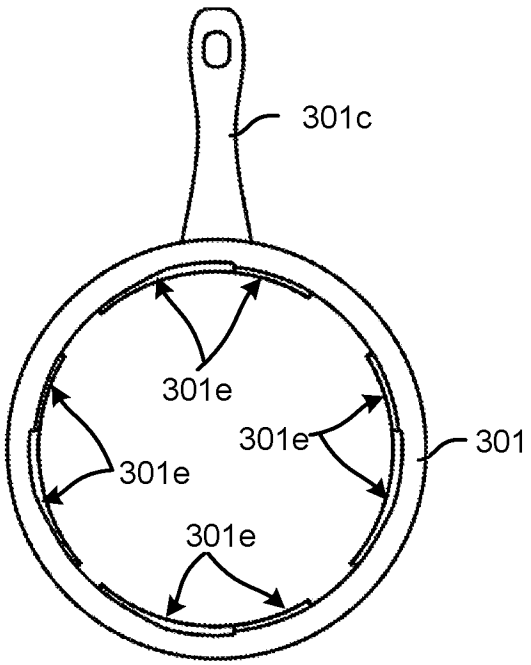

FIG. 29A-FIG. 29B illustrate the heated cookware appliance 301 having multiple twist-lock receiving members 301*e* evenly distributed along a top inner sidewall portion of the heated cookware appliance 301, according to another embodiment. The twist-lock receiving members 301*e* are generally thin sheets of metal (or other heat resistance materials) protruding from the sidewall portion of the heated cookware appliance 301 and having a shape that is complementary to that of the twist-lock grooves 301*d*2. In another implementation, the multiple twist-lock receiving members 301*e* may distributed along an outer sidewall portion of the heated cookware appliance 301, in contrast to the inner sidewall portion.

Figure 30B:
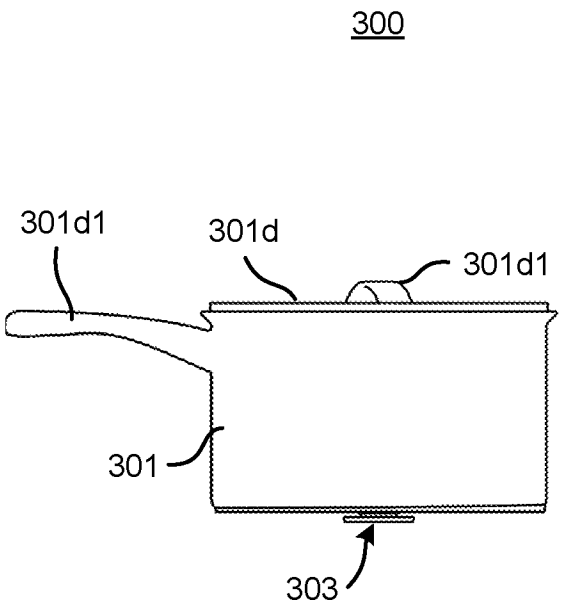
FIG. 30A-FIG. 30B illustrate a method of inserting the twist lock lid member to the twist-lock receiving members of the heated cookware appliance, according to another embodiment.
Figure 30A:
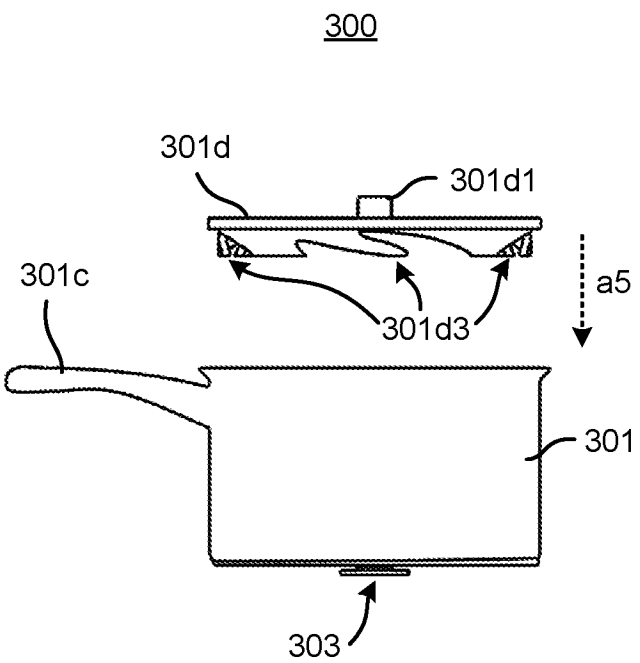

FIG. 30A-FIG. 30B illustrate a method of inserting (or removing) the twist lock lid member 301*d* to the twist-lock receiving members 301*e* of the heated cookware appliance 301, according to another embodiment. In application, the twist lock lid member 301*d* is place above the heated cookware appliance 301 with the twist lock lid member 301*d* in a first rotated position prior to insertion as shown in FIG. 30A. The twist lock lid member 301*d* is then lowered in a direction (a5) and aligned to the top portion of the heated cookware appliance 301 where the twist-lock grooves 301*d*2 make contact to the inner sidewall portion of the heated cookware appliance 301. Next, the twist lock lid member 301*d* is then slightly rotated via the lid handle 301*d*1 in a clockwise (or counterclockwise) direction to lock (or unlock) the twist lock lid member 301*d* from the twist-lock receiving members 301*e* of the heated cookware appliance 301.

Figure 31B:
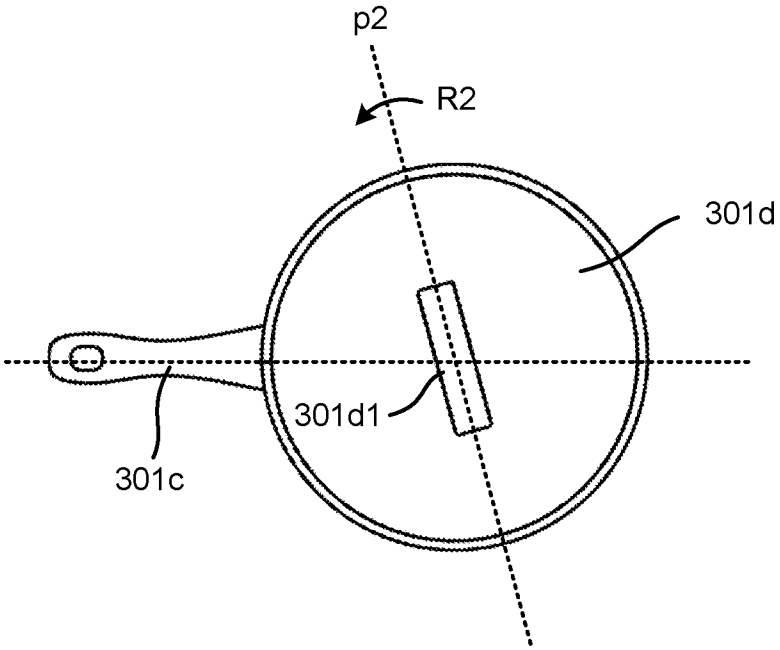
FIG. 31A-FIG. 31B illustrate a top view of the twist lock lid member and lid handle rotated in the unlocked and locked position, according to another embodiment.
Figure 31A:
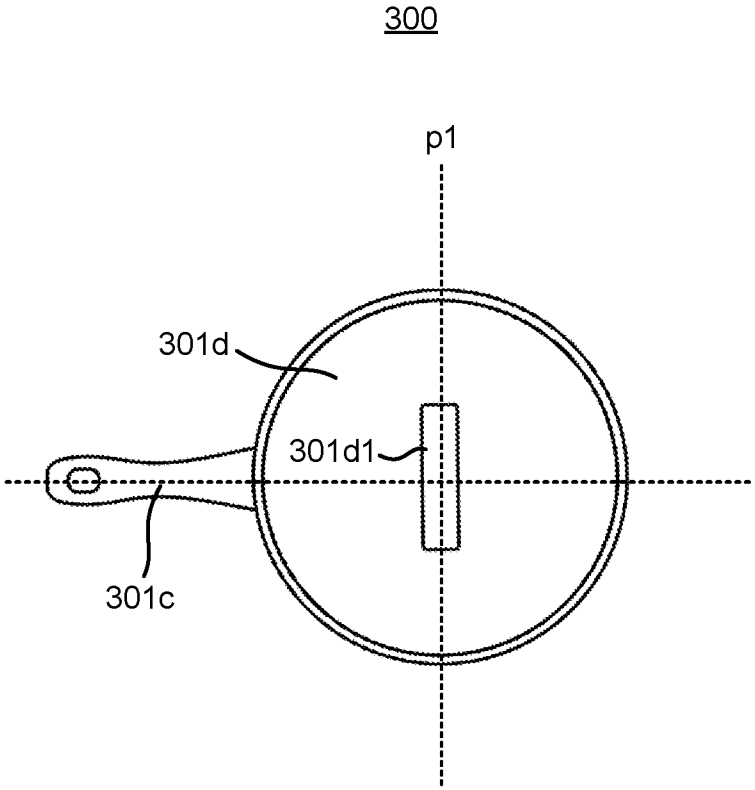

FIG. 31A-FIG. 31B illustrate a top view of the twist lock lid member 301*d* and lid handle 301*d*1 rotated in the unlocked and locked position, according to another embodiment. In the unlocked position, the lid handle 301*d*1 is at a first rotated position p1 relative to the handle 301*c* of the cookware 301 as shown in FIG. 31A. In the locked position, the lid handle 301*d*1 is rotated (R2) by the user at a second rotated position p2 relative to the handle 301*c* of the cookware 301 as shown in FIG. 31B.

Figure 32B:
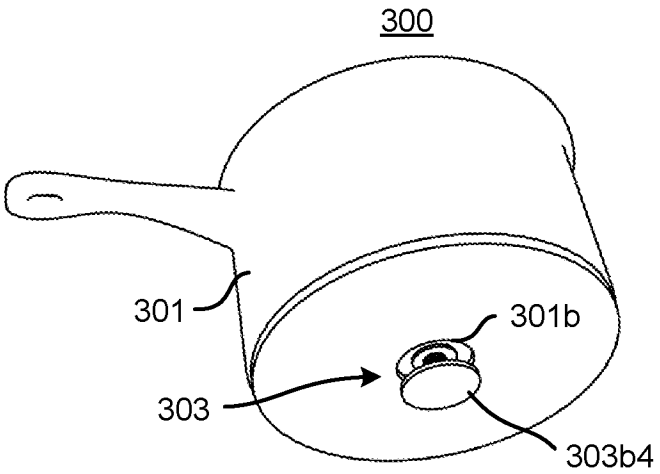
FIG. 32A-FIG. 32D illustrate multiple views of the safety cookware device with the keyed safety locking member having a push stem member, according to another embodiment.
Figure 32D:
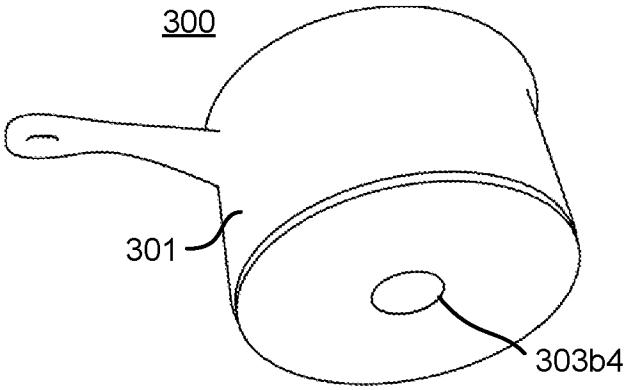
Figure 32A:
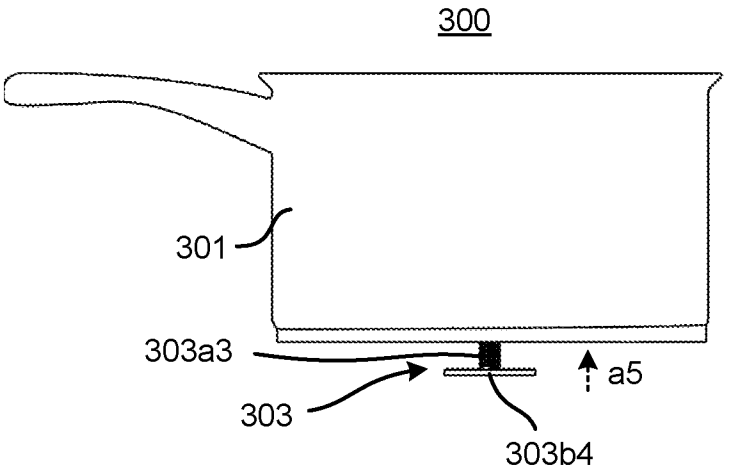
Figure 32C:
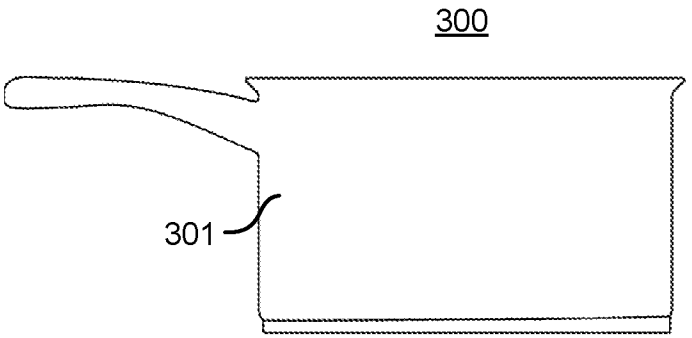

FIG. 32A-FIG. 32D illustrate multiple views of the safety cookware device 300 with the keyed safety locking member 303 having a push stem member 303*a*3, according to another embodiment. The push stem member 303*a*3 may include a spring loaded push rod tube configured to compress or decompress when the user applies and inward pressure on the keyed block member 303*b*4. In the decompressed state, the keyed safety locking member 303 is fully extended protruding below the heated cookware appliance 301 as shown in FIG. 32A and FIG. 32B. In the compressed state, the keyed safety locking member 303 is fully recessed into the recessed keyed block insert slot 301*b* of the heated cookware appliance 301, laying flushed to the bottom of the heated cookware appliance 301 as shown in FIG. 32A and FIG. 32B. In practice, the push stem member 303*a*3 may have the additional benefit of allowing the heated cookware appliance 301 to lay relatively flat on a tabletop or countertop surface while the push stem member 303*a*3 is in the collapsed state, and engage and lock into the rectangular slots (305*p*, 305*q*) of grate locking component of the grate 305.

Figure 33B:
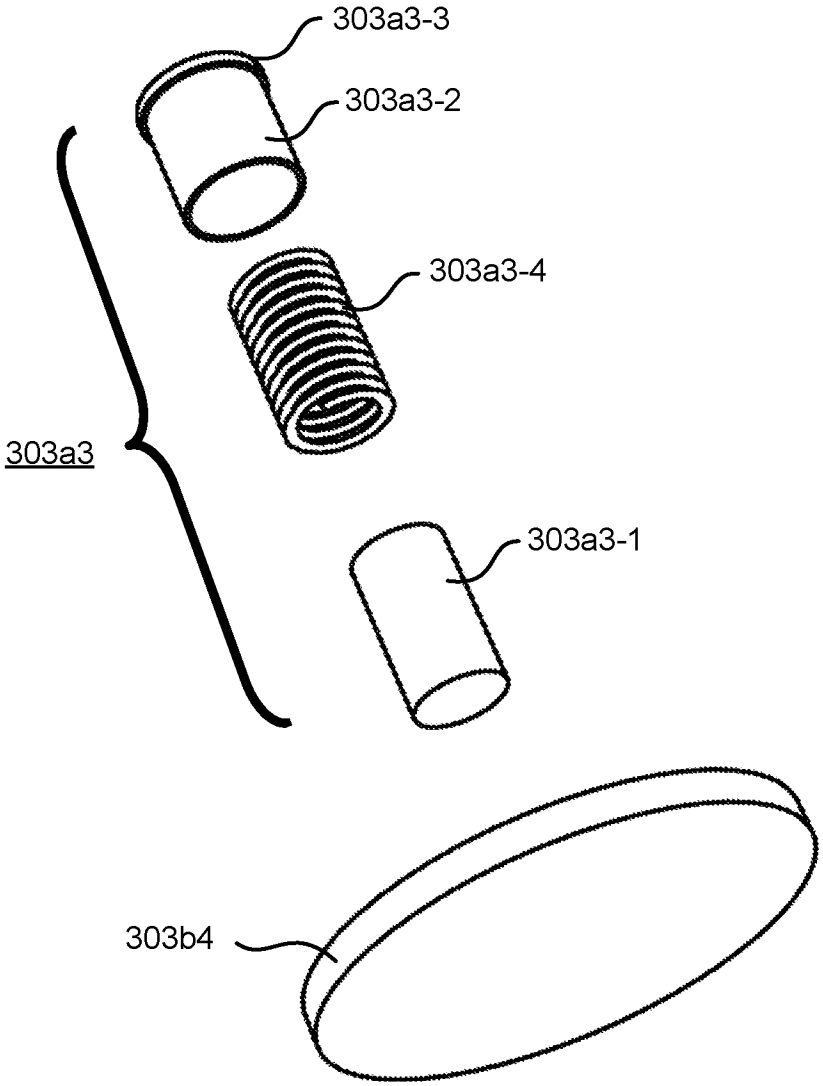
FIG. 33A-FIG. 33B illustrate an exploded views of the push stem member, according to another embodiment.
Figure 33A:
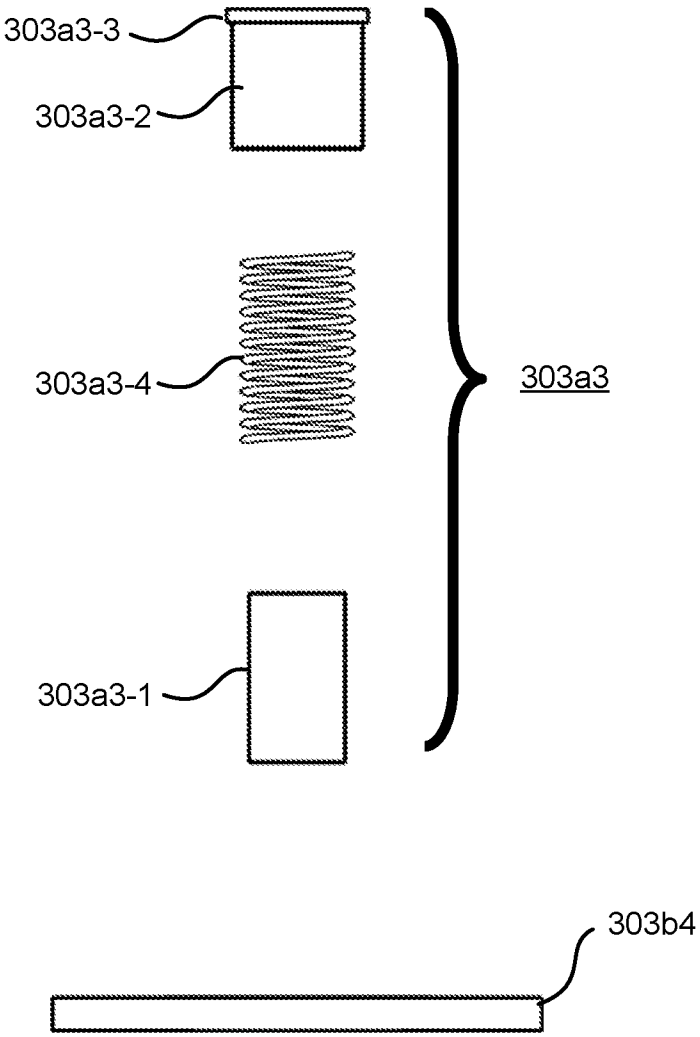

FIG. 33A-FIG. 33B illustrate an exploded views of the push stem member 303*a*3, according to another embodiment. As shown the exploded views, the push stem member 303*a*3 may include additional components such as a push shaft member **303*a*3-1 coupled to the keyed block member 303*b*4, barrel member 303*a*3-2 having a push cap member 303*a*3-3 for coupling the push stem member 303*a*3 to the bottom of the heated cookware appliance 301, and a spring member 303*a*3-4 disposed between the push shaft member 303*a*3-1 and the barrel member 303*a*3-2. The push stem member 303*a*3 may include additional component which allows it to lock and unlock the push stem member 303*a*3 into the barrel member 303*a*3-2. In operation, the push stem member 303*a*3** may act as a spring loaded push rod tube, allowing it to lock into a compress and decompress state when force is applied to it.

As used in the specification and the appended claims, the singular forms "a", "an", and "the" included plural referents unless the context clearly dictates otherwise.

The foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A safety grate and safety cookware system, comprising:

a safety cookware device having a heated cookware appliance and a keyed safety locking member, wherein the keyed safety locking member is coupled to a bottom portion of the heated cookware appliance, wherein the keyed safety locking member includes a keyed block member and a stem for coupling the keyed block member to the heated cookware appliance; and a keyed safety burner grate having an outer frame, a plurality of raised metal fingers coupled to an inner portion of the outer frame, a first rail member and a second rail member, separated by a fixed distance, wherein the first rail member and the second rail member are coupled to the inner portion of the outer frame, a grate locking component coupled to the first rail member and the second rail member, wherein the grate locking component includes a keyed slot for receiving the keyed block member when inserted into the keyed slot; and wherein the safety cookware device is configured to freely rotate around the grate locking component about the stem of the safety cookware device when inserted, wherein the safety cookware device is unlocked and removable from the keyed safety burner grate at an unlocked position when the keyed block member is first inserted into the keyed slot, and wherein the safety cookware device is locked and secured to the keyed safety burner grate at a locked position when the keyed block member is inserted into the keyed slot of the keyed safety burner grate and then rotated 45 degrees or more in a clockwise or counterclockwise direction.

2. The safety grate and safety cookware system of claim 1, wherein the keyed safety locking member is a thin oval-shaped plate and the grate locking component includes curvilinear metal members forming an oval slot.

3. The safety grate and safety cookware system of claim 1, wherein the keyed safety locking member is a thin egg-shaped plate and the grate locking component includes curvilinear metal members forming an egg-shaped keyed insert slot.

4. The safety grate and safety cookware system of claim 1, wherein the keyed safety locking member is a thin rectangular plate and the grate locking component includes metal members forming a rectangular shaped insert slot.

5. The safety grate and safety cookware system of claim 1, wherein the keyed safety locking member is detachably coupled to the heated cookware appliance, wherein the keyed safety locking member includes a plurality of protruding locking members coupled to a top edge portion of the stem, and the heated cookware appliance includes a slot and a plurality of recessed channel members formed along a portion of the slot, wherein a portion of the stem and the plurality of protruding locking members are configured to mate with the slot and the plurality of recessed channel members, and wherein the portion of the stem and the plurality of protruding locking members are configured to lock into the slot and the plurality of recessed channel members by twisting the keyed safety locking member in a clockwise or counterclockwise direction.

6. The safety grate and safety cookware system of claim 1, wherein the stem includes a collapsible and expandable stem assembly having a retractable member.

7. The safety grate and safety cookware system of claim 6, wherein the retractable member includes a metal mesh tubing, a plurality of metal cones, a folding wire cage, a plurality of folding plates, or a spring.

8. The safety grate and safety cookware system of claim 7, wherein the heated cookware appliance includes a recessed keyed block insert slot disposed on a bottom middle portion of the heated cookware appliance, wherein the retractable member is compressed and inserted into the recessed keyed block insert slot when the collapsible and expandable stem assembly is fully collapsed, and wherein the retractable member is extended and projected away from the heated cookware appliance when the collapsible and expandable stem assembly is fully expanded.

9. The safety grate and safety cookware system of claim 7, wherein the heated cookware appliance includes a handle and a stem release and lock lever coupled to the handle, wherein the stem release and lock lever is configured to control the collapsible and expandable stem assembly.

10. The safety grate and safety cookware system of claim 1, wherein the heated cookware appliance includes a twist lock lid member configured to lock and unlock onto a top portion of the heated cookware appliance, wherein the twist lock lid member includes a pressure release vent disposed on a top portion of the twist lock lid member.

11. The safety grate and safety cookware system of claim 1, wherein the stem includes a push stem member, wherein the push stem member is configured to compress and decompress when an inward force is applied to a portion of the push stem member, wherein the keyed safety locking member is fully extended protruding below the heated cookware appliance when the push stem member is decompressed, and the keyed safety locking member is fully recessed into a recessed keyed block insert slot of the heated cookware appliance, laying flushed to the bottom portion of the heated cookware appliance when the push stem member is compressed.

12. A safety grate and safety cookware system, comprising:

a safety cookware device having a heated cookware appliance and a keyed safety locking member, wherein the keyed safety locking member is coupled to a bottom portion of the heated cookware appliance, wherein the keyed safety locking member includes a keyed block member and a stem for coupling the keyed block member to the heated cookware appliance; and a keyed safety burner grate having an outer frame, a plurality of raised metal fingers coupled to an inner portion of the outer frame, a channel insert slot formed by two insert guide rail members coupled to a first end of the outer frame, two stem guide rail members coupled to a second end of the outer frame, and a grate locking component having a channel stop coupling the two insert guide rail members with the two stem guide rail members, wherein the two insert guide rail members are separated by a first fixed distance at the first end of the outer frame, and the two stem guide rail members are separated by a second fixed distance at the second end of the outer frame, wherein the first fixed distance is greater than the second fixed distance; and wherein the stem and the keyed block member of the safety cookware device is inserted into the channel insert slot prior to locking the keyed block member to the grate locking component, and wherein the stem and the keyed block member is inserted and then locked into the grate locking component, stopping at the channel stop.

13. The safety grate and safety cookware system of claim 12, wherein the keyed block member has an elongated rhombus shaped body or a disc plate, and wherein grooves or slots are disposed along a portion of each stem guide rail member for receiving and mating with the keyed block member.

14. The safety grate and safety cookware system of claim 12, wherein the keyed safety locking member is detachably coupled to the heated cookware appliance, wherein the keyed safety locking member includes a plurality of protruding locking members coupled to a top edge portion of the stem, and the heated cookware appliance includes a slot and a plurality of recessed channel members formed along a portion of the slot, wherein a portion of the stem and the plurality of protruding locking members are configured to mate with the slot and the plurality of recessed channel members, and wherein the portion of the stem and the plurality of protruding locking members are configured to lock into the slot and the plurality of recessed channel members by twisting the keyed safety locking member in a clockwise or counterclockwise direction.

15. The safety grate and safety cookware system of claim 12, wherein the stem includes a collapsible and expandable stem assembly having a retractable member.

16. The safety grate and safety cookware system of claim 15, wherein the retractable member includes a metal mesh tubing, a plurality of metal cones, a folding wire cage, a plurality of folding plates, or a spring.

17. The safety grate and safety cookware system of claim 16, wherein the heated cookware appliance includes a recessed keyed block insert slot disposed on a bottom middle portion of the heated cookware appliance, wherein the retractable member is compressed and inserted into the recessed keyed block insert slot when the collapsible and expandable stem assembly is fully collapsed, and wherein the retractable member is extended and projected away from the heated cookware appliance when the collapsible and expandable stem assembly is fully expanded.

18. The safety grate and safety cookware system of claim 16, wherein the heated cookware appliance includes a handle and a stem release and lock lever coupled to the handle, wherein the stem release and lock lever is configured to control the collapsible and expandable stem assembly.

19. The safety grate and safety cookware system of claim 12, wherein the heated cookware appliance includes a twist lock lid member configured to lock and unlock onto a top portion of the heated cookware appliance, wherein the twist lock lid member includes a pressure release vent disposed on a top portion of the twist lock lid member.

20. The safety grate and safety cookware system of claim 12, wherein the stem includes a push stem member, wherein the push stem member is configured to compress and decompress when an inward force is applied to a portion of the push stem member, wherein the keyed safety locking member is fully extended protruding below the heated cookware appliance when the push stem member is decompressed, and the keyed safety locking member is fully recessed into a recessed keyed block insert slot of the heated cookware appliance, laying flushed to the bottom portion of the heated cookware appliance when the push stem member is compressed.

* * * * *